US010811174B2

(12) United States Patent
Imahashi et al.

(10) Patent No.: US 10,811,174 B2
(45) Date of Patent: Oct. 20, 2020

(54) CHIP RESISTOR AND METHOD FOR MANUFACTURING SAME

(71) Applicant: Rohm Co., Ltd., Kyoto-shi, Kyoto (JP)

(72) Inventors: Wataru Imahashi, Kyoto (JP); Takanori Shinoura, Kyoto (JP)

(73) Assignee: ROHM CO., LTD., Kyoto (JP)

( * ) Notice: Subject to any disclaimer, the term of this patent is extended or adjusted under 35 U.S.C. 154(b) by 0 days.

(21) Appl. No.: 16/466,256

(22) PCT Filed: Nov. 30, 2017

(86) PCT No.: PCT/JP2017/042993
§ 371 (c)(1),
(2) Date: Jun. 3, 2019

(87) PCT Pub. No.: WO2018/123419
PCT Pub. Date: Jul. 5, 2018

(65) Prior Publication Data

US 2020/0066429 A1 Feb. 27, 2020

(30) Foreign Application Priority Data

Dec. 27, 2016 (JP) ..... 2016-252777

(51) Int. Cl.
*H01C 1/14* (2006.01)
*H01C 17/00* (2006.01)
(Continued)

(52) U.S. Cl.
CPC ..... *H01C 7/003* (2013.01); *H01C 1/01* (2013.01); *H01C 1/14* (2013.01); *H01C 17/006* (2013.01);
(Continued)

(58) Field of Classification Search
CPC ..... H01C 7/003; H01C 1/14; H01C 17/006; H01C 17/065; H01C 17/281
See application file for complete search history.

(56) References Cited

U.S. PATENT DOCUMENTS 5,379,016 A * 1/1995 Smith ..... H01C 7/003 338/195
5,952,911 A * 9/1999 Kawase ..... H01C 1/142 338/22 R
(Continued)

FOREIGN PATENT DOCUMENTS

JP 2008-72152 A 3/2008
JP 2011-165752 A 8/2011
(Continued)

OTHER PUBLICATIONS

International Search Report issued in PCT/JP2017/042993, Feb. 27, 2018 (2 pages).

*Primary Examiner* — Kyung S Lee
(74) *Attorney, Agent, or Firm* — Hamre, Schumann, Mueller & Larson, P.C.

(57) ABSTRACT

One aspect of the present disclosure provides a chip resistor. In the chip resistor, a top electrode is disposed on a front surface of a substrate. A resistor is disposed on the front surface and electrically connected to the top electrode. A protective layer covers the resistor. A protective electrode is electrically connected to the top electrode. A side electrode is electrically connected to the top electrode. The side electrode has a side portion disposed on the side surface, and a top portion and a bottom portion respectively overlapping the front surface and the back surface in plan view. An intermediate electrode covers the protective electrode and the side electrode. An outer electrode covers the intermediate electrode. The protective electrode is in contact with both the top electrode and the protective layer and covers a portion of the top electrode and a portion of the protective layer.

20 Claims, 16 Drawing Sheets

(51) Int. Cl.

| | |
|---|---|
| ***H01C 7/00*** | (2006.01) |
| ***H01C 1/01*** | (2006.01) |
| ***H01C 17/065*** | (2006.01) |
| ***H01C 17/28*** | (2006.01) |

(52) U.S. Cl.
CPC ..... *H01C 17/065* (2013.01); *H01C 17/281* (2013.01)

(56) References Cited

U.S. PATENT DOCUMENTS 6,859,133 B2 * 2/2005 Nakanishi ..... H01C 7/003 338/309
7,782,173 B2 * 8/2010 Urano ..... H01C 1/012 338/307
7,782,174 B2 * 8/2010 Urano ..... H01C 1/012 338/307
7,825,769 B2 * 11/2010 Nomura ..... H01C 1/012 338/309
8,193,899 B2 * 6/2012 Takeuchi ..... H01C 1/06 338/262
2003/0156008 A1 * 8/2003 Nakanishi ..... H01C 1/148 338/309
2010/0201477 A1 * 8/2010 Yang ..... H01C 1/032 338/309
2015/0357097 A1 * 12/2015 Tsai ..... H01C 1/142 338/309

FOREIGN PATENT DOCUMENTS

JP 2013-153137 A 8/2013
JP 2016-92127 A 5/2016
JP 2016-157980 A 9/2016

* cited by examiner

CHIP RESISTOR AND METHOD FOR MANUFACTURING SAME

TECHNICAL FIELD

The present disclosure relates to a chip resistor and a method for manufacturing the same.

BACKGROUND ART

The electrodes of a chip resistor include top electrodes disposed on the top surface of a substrate and electrically connected to a resistor. The top electrodes typically contain Ag particles, which react with sulfuric gas (such as $H_2S$, $SO_2$ and so on) to form black silver sulfide acting as an electrical insulator. If the chip resistor mounted on a circuit board is placed in an atmosphere containing sulfuric gas, the Ag particles in the top electrodes form black silver sulfide ($Ag_2S$). Increase of silver sulfide on the top electrodes may eventually break the electrical continuity of the electrodes of the chip resistor.

A chip resistor may include a substrate (insulating substrate), top electrodes (upper terminal electrodes) disposed on the substrate, a resistor (resistive element) electrically connected to the top electrodes, a protective layer (protective coating) covering the resistor, and intermediate electrodes (nickel plates) covering the top electrodes. In the chip resistor, metal layers are deposited by sputtering on the opposite side surfaces of the substrate in a longitudinal direction of the chip resistor. The metal layers cover the edges of the protective layer. The intermediate electrodes are in contact with the top electrodes and the edges of the protective layer, the edges covering the top electrodes and covered by the metal layers. That is, the edges of the protective layer defining the boundaries with the top electrodes are securely covered by the intermediate electrodes. This configuration is effective to prevent ingress of sulfuric gas from the edges of the protective layer to the top electrodes, rendering the top electrodes more resistant against sulfurization.

Regarding such a chip resistor, the present inventor has recognized that the metal layers covering the edges of the protective layer may involve a risk of peeling, depending on the fabrication conditions of the metal layers. In addition, if a metal layer formed on the edge of a protective layer peels away, the intermediate electrode formed on the metal layer will be peeled together from the edge of the protective layer. This leaves the edge of the protective layer vulnerable to ingress of sulfuric gas to the top electrode. Therefore, peeling of the metal layers formed on the edges of the protective layer is undesirable in that it may weaken the protection of the top electrodes against sulfurization.

SUMMARY OF THE INVENTION

In view of the above circumstances, the present disclosure aims to provide a chip resistor with improved resistance to sulfurization and a method of manufacturing the same.

A first aspect of the present disclosure provides a chip resistor. The chip resistor includes a substrate, a top electrode, a resistor, a protective layer, a protective electrode, a side electrode, an intermediate electrode and an outer electrode. The substrate has a front surface and a back surface spaced apart from each other in a thickness direction, and a side surface between the front surface and the back surface. The top electrode is disposed on the front surface. The resistor is disposed on the front surface and electrically connected to the top electrode. The protective layer covers the resistor. The protective electrode is electrically connected to the top electrode. The side electrode is electrically connected to the top electrode. The side electrode has a side portion disposed on the side surface, and a top portion and a bottom portion respectively overlapping the front surface and the back surface in plan view. The intermediate electrode covers the protective electrode and the side electrode. The outer electrode covers the intermediate electrode. The protective electrode is in contact with both the top electrode and the protective layer and covers a portion of the top electrode and a portion of the protective layer.

A second aspect of the present disclosure provides a method of manufacturing a chip resistor. The method includes: forming, on a sheet-like base having a front surface and a back surface spaced apart from each other in a thickness direction, a top electrode having two separate regions disposed in contact with the front surface; forming a resistor having a first edge and a second edge both in contact with the top electrode; forming a protective layer covering the resistor; forming a protective electrode in contact with both the top electrode and the protective layer; dividing the base into a plurality of strips, each of the plurality of strips having a side surface between the front surface and the back surface; forming a side electrode in contact with the side surface of one of the plurality of strips, the side electrode having a portion overlapping the front surface and a portion overlapping the back surface both in plan view; forming an intermediate electrode covering the protective electrode and the side electrode; and forming an outer electrode covering the intermediate electrode.

Other features and advantages of the present disclosure will be more apparent from the detailed description given below with reference to the accompanying drawings.

MODE FOR CARRYING OUT THE INVENTION

Modes for carrying out the present disclosure (hereinafter, "embodiments") will be described with reference to the accompanying drawings.

First Embodiment

With reference to FIGS. 1 to 6, the following describes a chip resistor A10 according to a first embodiment of the present disclosure. The chip resistor A10 includes a substrate 1, a resistor 2, electrodes 3 and a protective layer 4.

Figure 1:
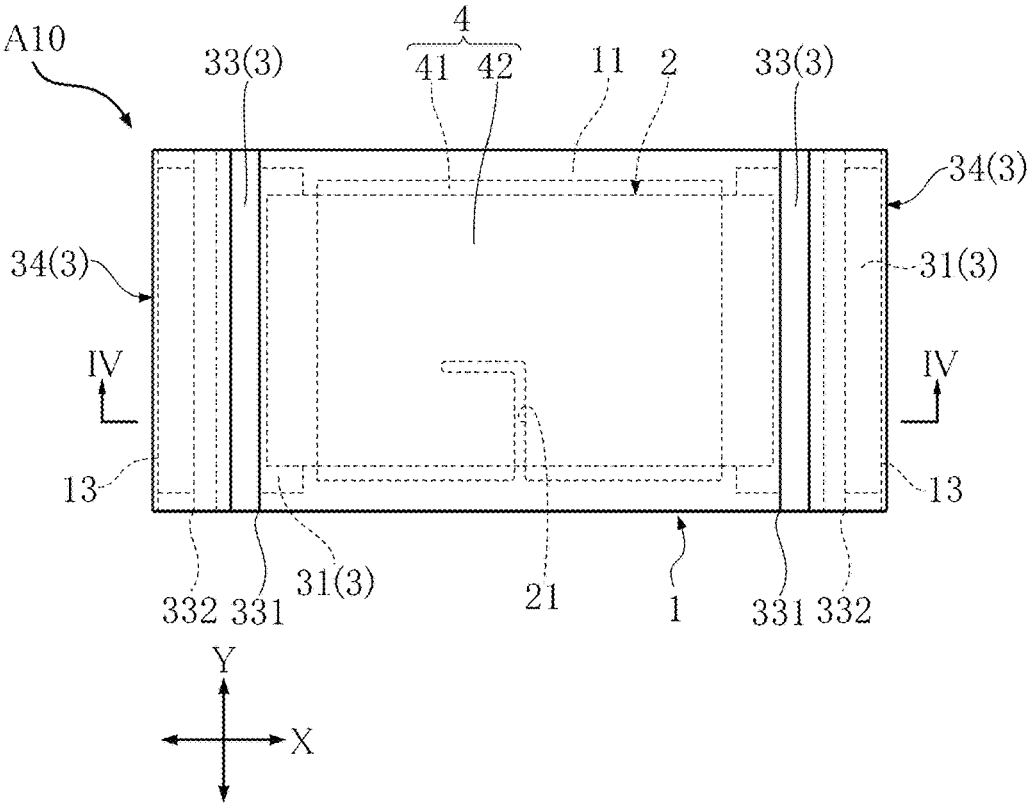
FIG. 1 is a plan view of a chip resistor according to a first embodiment of the present disclosure (seen through an intermediate electrode and an intermediate electrode).
Figure 2:
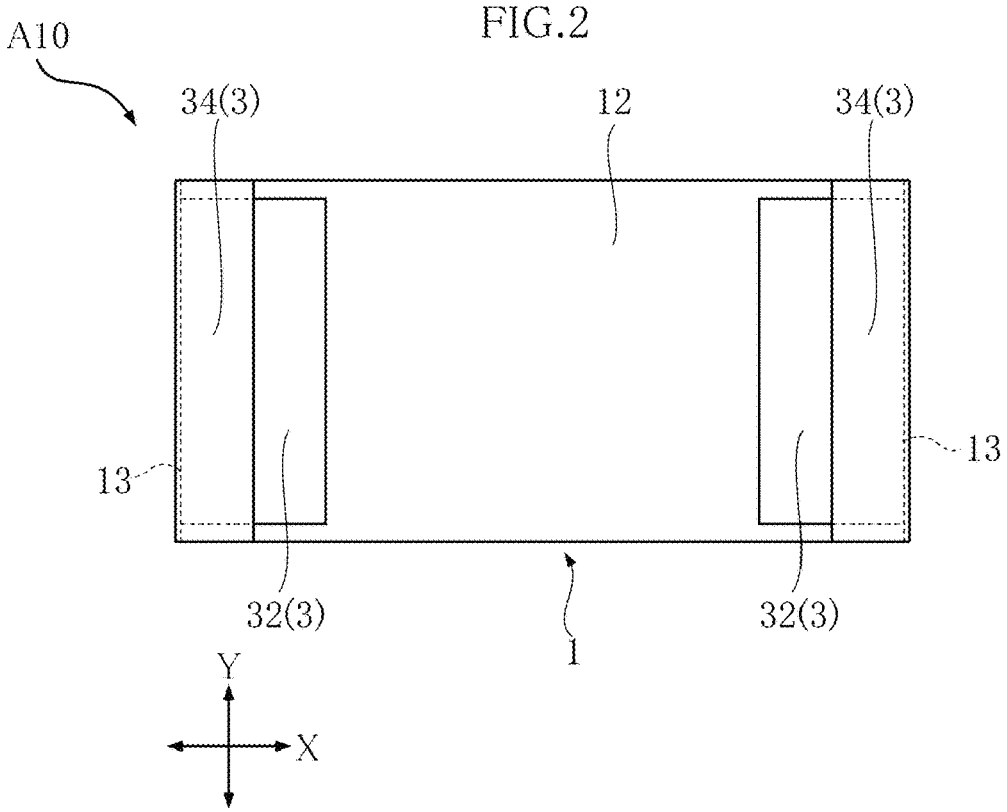
FIG. 2 is a bottom view of the chip resistor shown in FIG. 1.
Figure 3:
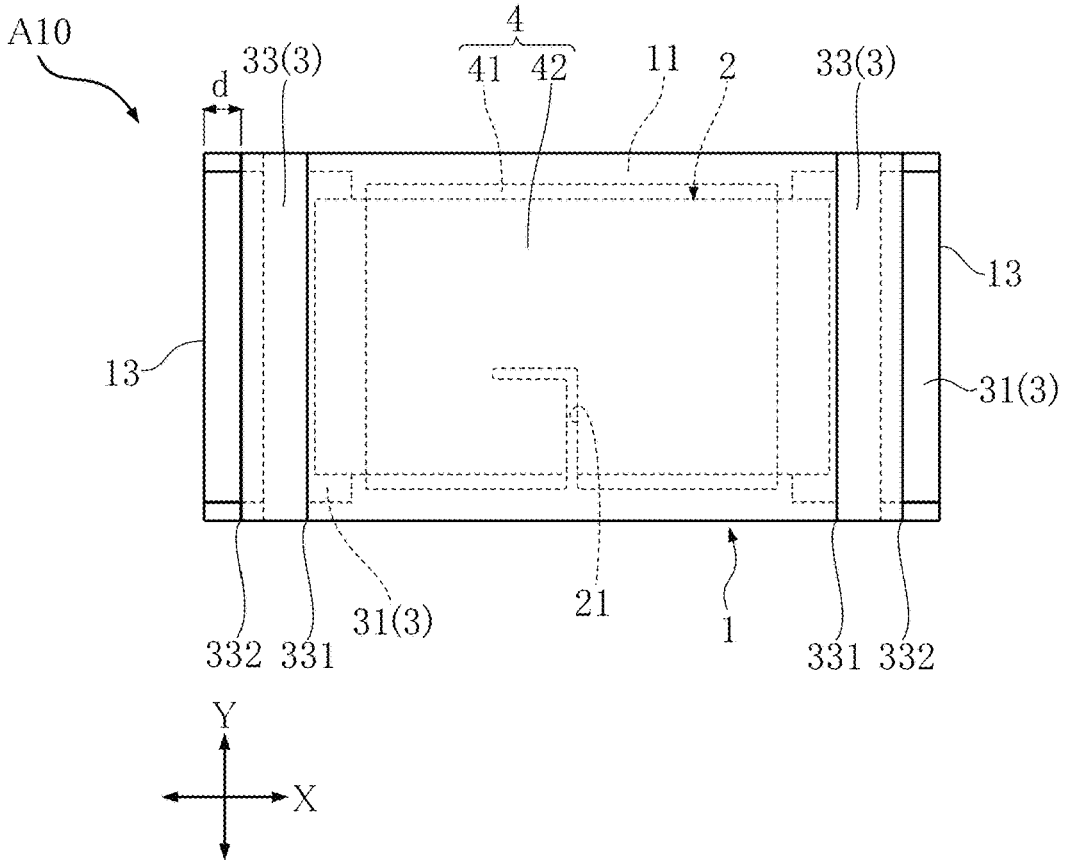
FIG. 3 is a plan view of the chip resistor shown in FIG. 1 (seen through side electrodes, intermediate electrodes and outer electrodes).
Figure 4:
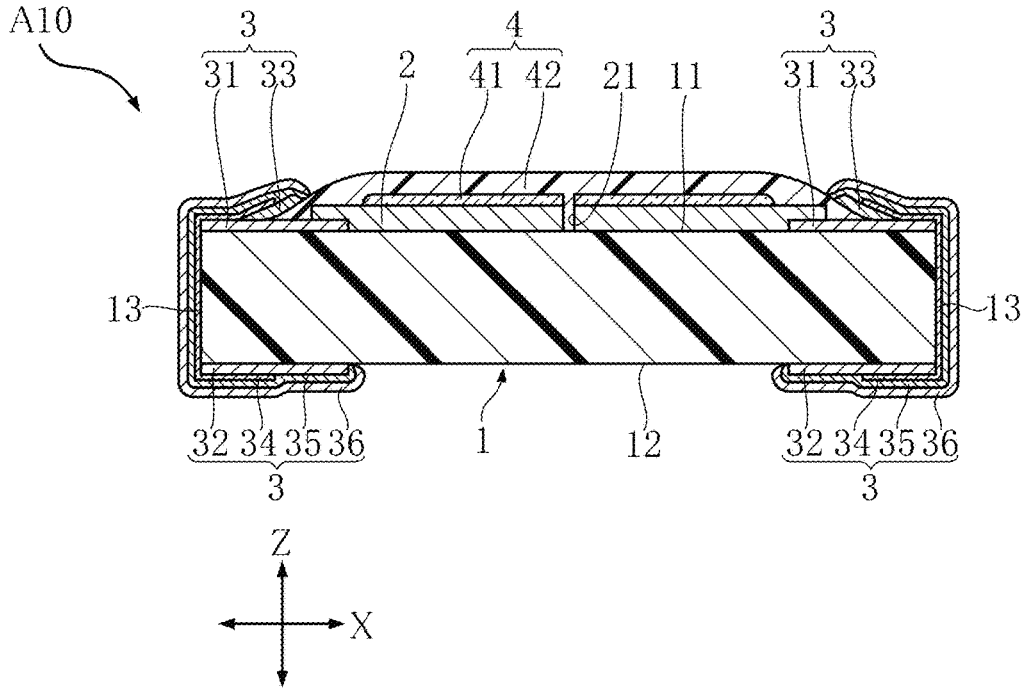
FIG. 4 is a sectional view taken along line IV-IV of FIG. 1.
Figure 5:
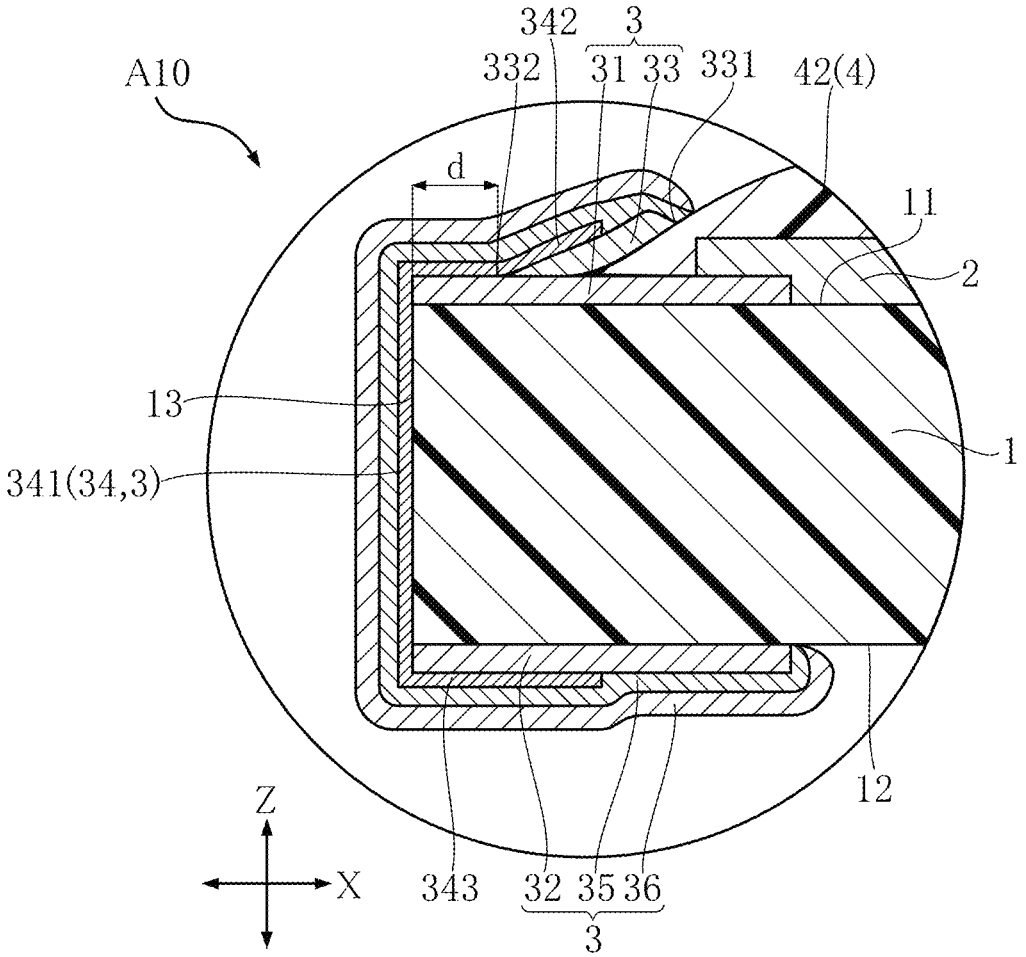
FIG. 5 is a partially enlarged view of FIG. 4.
Figure 6:
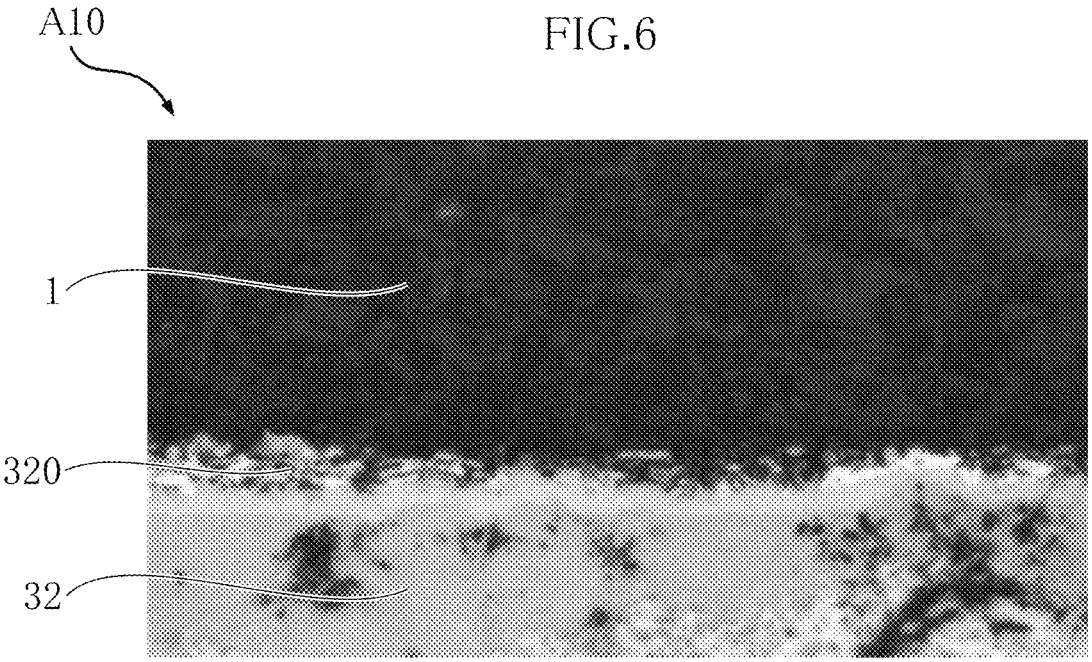
FIG. 6 is a partially enlarged sectional view showing a back electrode of the chip resistor shown in FIG. 1.

FIG. 1 is a plan view of the chip resistor A10, and FIG. 2 is a bottom view of the chip resistor A10. For convenience, FIGS. 1 and 2 are seen through intermediate electrodes 35 and outer electrodes 36, which are parts of the electrodes 3 as will be described later. FIG. 3 is a plan view corresponding to FIG. 1 seen through side electrodes 34, which are parts of the electrodes 3 as will be described later. FIG. 4 is a sectional view taken along line IV-IV of FIG. 1. FIG. 5 is a partially enlarged view of FIG. 4. FIG. 6 is a partially enlarged sectional view of a back electrode 32, which is a part of the electrodes 3 of the chip resistor A10 as will be described later.

The chip resistor A10 shown in the figures is suited for surface mounting on the circuit boards of various electronic devices. The chip resistor A10 is a thick film (metal-glaze film) chip resistor. As shown in FIG. 1, the substrate 1 of the chip resistor A10 is rectangular as viewed in the thickness direction Z (herein after, "plan view"). For convenience, the longitudinal direction of the chip resistor A10 perpendicular to the thickness direction Z of the substrate 1 is referred to as a first direction. The short direction of the chip resistor A10 perpendicular to both the thickness direction Z and the first direction X of the substrate 1 is referred to as the second direction Y.

As shown in FIGS. 1 to 4, the substrate 1 is a component for holding a resistor 2 thereon and for mounting the chip resistor A10 on a circuit board. The substrate 1 is rectangular in plan view. In addition, the substrate 1 is electrically insulating. In the present embodiment, the substrate 1 is made of alumina ($Al_2O_3$). The substrate 1 made of a highly heat-conductive material is preferred to dissipate heat of the resistor 2 during operation of the chip resistor A10. The substrate 1 has a front surface 11, a back surface 12 and side surfaces 13.

As shown in FIGS. 1 to 4, the front surface 11 and the back surface 12 are spaced apart from each other in the thickness direction Z of the substrate 1. The front surface 11 comprises an upper surface of the substrate 1 as seen in FIG. 4, and the resistor 2 is mounted on this surface. The back surface 12 comprises a lower surface of the substrate 1 as seen in FIG. 4. Once the chip resistor A10 is mounted on a circuit board, the back surface 12 faces the circuit board.

As shown in FIGS. 1 to 4, the side surfaces 13 between the front surface 11 and the back surface 12. In the present embodiment, the side surfaces 13 comprise a pair of surfaces spaced apart from each other in the first direction X. The side surfaces 13 are covered by the electrodes 3.

The resistor 2 is disposed on the front surface 11 of the substrate 1 as shown in FIGS. 1, 3 and 4 and electrically connected to top electrodes 31, which are parts of the electrodes 3 as will be described later. The resistor 2 can achieve the function of limiting or detecting the flow of electric current, for example. In the present embodiment, the resistor 2 has a strip shape elongated in the first direction X in plan view. Alternatively, the resistor 2 may have any other shape, such as a serpentine shape, depending on a desired resistance of the chip resistor A10. The resistor 2 of the present embodiment contains $Ruo_2$ or an Ag—Pd alloy, in addition to glass.

As shown in FIGS. 1, 3 and 4, the resistor 2 has a trimming groove 21 formed therethrough in the thickness direction Z of the substrate 1. In the present embodiment, the trimming groove 21 defines an L-shape in plan view and has an open end in a face of the resistor 2 extending parallel to the first direction X.

The electrodes 3 are electrically conductive components connected to the resistor 2 as shown in FIGS. 1 to 5 and used to mount the chip resistor A10 on a circuit board. In this embodiment, the electrodes 3 are a pair of assemblies spaced apart from each other in the first direction X across the resistor 2. Each electrode 3 of the present embodiment comprises a top electrode 31, aback electrode 32, a protective electrode 33, a side electrode 34, an intermediate electrode 35 and an outer electrode 36.

As shown in FIGS. 1 and 3 to 5, the top electrodes 31 are parts of the electrodes 3 disposed in contact with the front surface 11 of the substrate 1. The top electrodes 31 are composed of a pair of components spaced apart from each other in the first direction X. The top electrodes 31 are in contact with the resistor 2 and thus electrically connected to the resistor 2. The top electrodes 31 are rectangular in plan view. In the present embodiment, the top electrodes 31 contain Ag and glass.

As shown in FIGS. 2, 4 and 5, the back electrodes 32 are parts of the electrodes 3 disposed in contact with the back surface 12 of the substrate 1 and in electrical connection with the side electrodes 34. Similarly to the top electrodes 31, the back electrodes 32 are composed of a pair of components spaced apart from each other in the first direction X. The back electrodes 32 include a synthetic resin containing conductive particles 320. In the present embodiment, the back electrodes 32 are made of a synthetic resin containing conductive particles 320. The synthetic resin may be a flexible epoxy resin. As shown in FIG. 6, the conductive particles 320 of the present embodiment are flakes of metal, which is Ag. The dimensions of the conductive particles 320 in a direction perpendicular to the thickness direction fall within a range of 5 to 15 μm in long-side dimension and 2 to 5 μm in short-side dimension.

As shown in FIGS. 1 and 3 to 5, the protective electrodes 33 are parts of the electrodes 3 electrically connected to the top electrodes 31. One protective electrode 33 is provided for each top electrode 31. Each protective electrode 33 is in contact with and covers a portion of both the top electrode 31 and an upper protective layer 42, which is included in the protective layer 4 as will be described later. The protective electrode 33 has a first edge 331 and a second edge 332 both of which are parallel to the side surfaces 13 of the substrate 1 in plan view. The first edge 331 is in contact with the upper protective layer 42 (protective layer 4), and the second edge 332 is in contact with the top electrode 31. In the present embodiment shown in FIGS. 3 and 5, a gap d is provided between the second edge 332 and the side surface 13 in plan view. That is, the top electrode 31 is visible through the gap d, provided that the side electrode 34, the intermediate electrode 35 and the outer electrode 36 are transparent as in FIG. 3. In the present embodiment, the protective electrodes 33 are made of a synthetic resin containing metal particles. The metal particles are Ag particles. The synthetic resin may be an epoxy resin. In another embodiment, the protective electrodes 33 may contain flaky carbon particles instead of the metal particles. The dimensions of such carbon particles in a direction perpendicular to the thickness direction fall within a range of 5 to 15 μm in long-side dimension and 2 to 5 μm in short-side dimension.

As shown in FIGS. 1, 4 and 5, the side electrodes 34 are parts of the electrodes 3 each electrically connected to both a top electrode 31 and a back electrode 32. Each side electrode 34 has a side portion 341, a top portion 342 and a bottom portion 343. The side portion 341 is disposed in contact with a side surface 13 of the substrate 1. The top portion 342 overlaps the front surface 11 of the substrate 1 in plan view. In the present embodiment, the top portion 342 is in contact with a top electrode 31 and a protective electrode 33. Specifically, the top portion 342 contacts the top electrode 31 in a region located in the gap d, and with the protective electrode 33 in the other region. The bottom portion 343 overlaps the back surface 12 of the substrate 1 in plan view. In the present embodiment, the bottom portion 343 contacts a back electrode 32. The side electrodes 34 thus electrically connects the top electrode 31 and the back electrode 32. In the present embodiment, the side electrodes 34 are made of a Ni—Cr alloy. The protective electrodes 33 may be made of any material that is electrically conductive and resistant to sulfurization.

As shown in FIGS. 4 and 5, the intermediate electrodes 35 are parts of the electrodes 3 each covering a back electrode 32, a protective electrode 33 and a side electrode 34. Each intermediate electrode 35 is disposed on the side electrode 34, and also on a portion of the back electrode 32 and a portion of the protective electrode 33. In the present embodiment, the intermediate electrodes 35 are made of Ni.

As shown in FIGS. 4 and 5, the outer electrodes 36 are portions of the electrodes 3 each covering an intermediate electrode 35. The outer electrodes 36 of the present embodiment are made of Sn. In a reflow process for mounting the chip resistor A10 on a circuit board, the outer electrodes 36 will melt and merge with solder paste applied to the circuit board.

As shown in FIGS. 1, 3 and 4, the protective layer 4 covers the resistor 2. In the present embodiment, the protective layer 4 comprises a lower protective layer 41 and the upper protective layer 42.

As shown in FIGS. 1, 3 and 4, the lower protective layer 41 is in contact with the resistor 2. The lower protective layer 41 has a groove formed therethrough in the thickness direction Z of the substrate 1. The shape of the groove is identical to the trimming groove 21 in the resistor 2. The resistor 2 extends beyond the edges of the lower protective layer 41 in the first direction X. In the present embodiment, the lower protective layer 41 contain glass.

As shown in FIGS. 1, 3 and 4, the upper protective layer 42 is disposed on the lower protective layer 41. The upper protective layer 42 covers the lower protective layer 41 and the resistor 2, and in contact with a portion of the front surface 11 of the substrate 1 and a portion of the top electrode 31. In addition, a portion of the protective electrode 33 contacts the upper surface of the upper protective layer 42 from above as seen in FIG. 5. The upper protective layer 42 of the present embodiment is made of an epoxy resin.

With reference to FIGS. 7 to 19, the following now describes a method of manufacturing the chip resistor A10.

Figure 14:
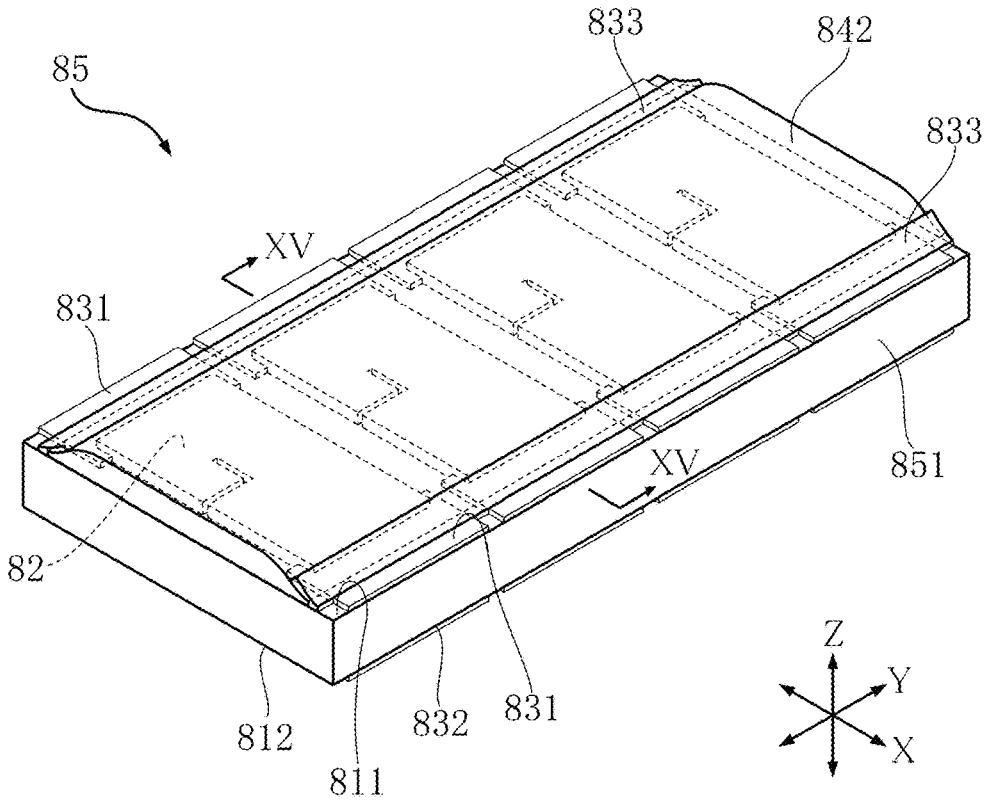
FIG. 14 is a perspective view illustrating a method of manufacturing the chip resistor shown in FIG. 1.
Figure 15:
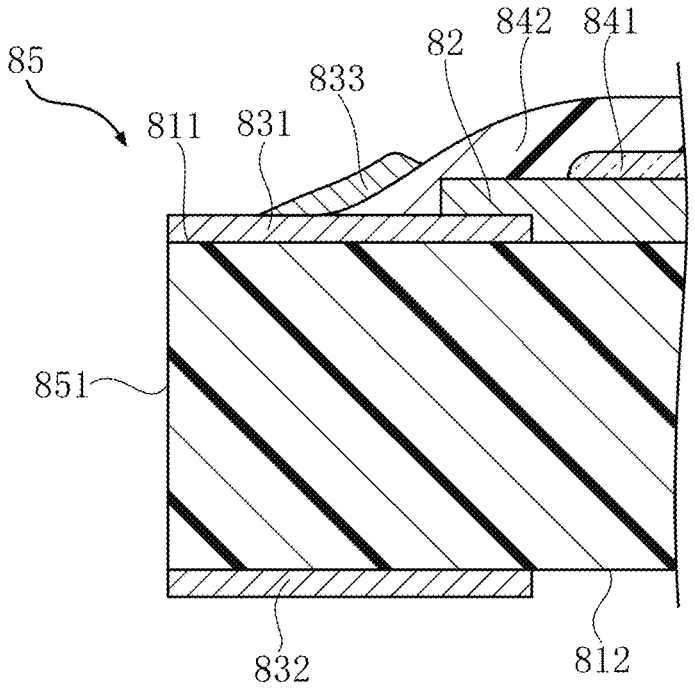
FIG. 15 is a sectional view taken along line XV-XV of FIG. 14.
Figure 16:
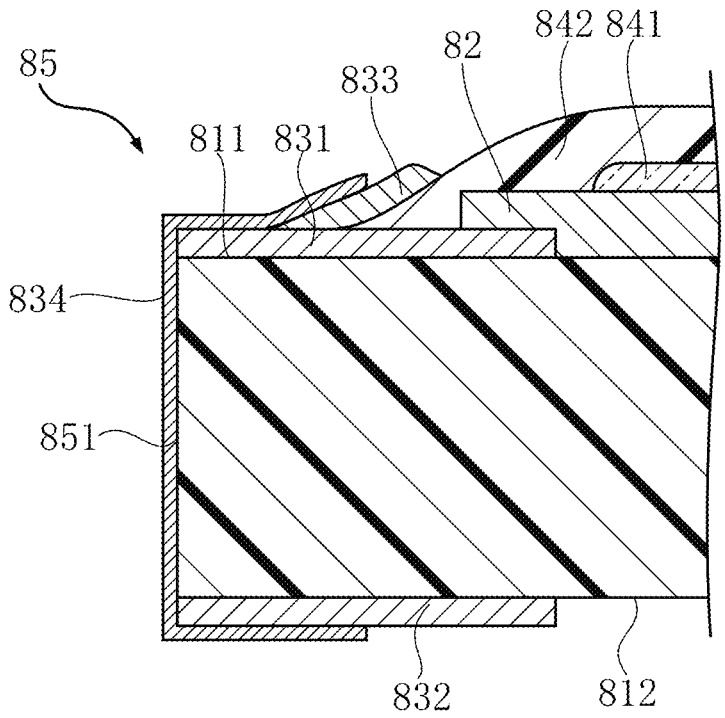
FIG. 16 is a sectional view illustrating a method of manufacturing the chip resistor shown in FIG. 1.
Figure 17:
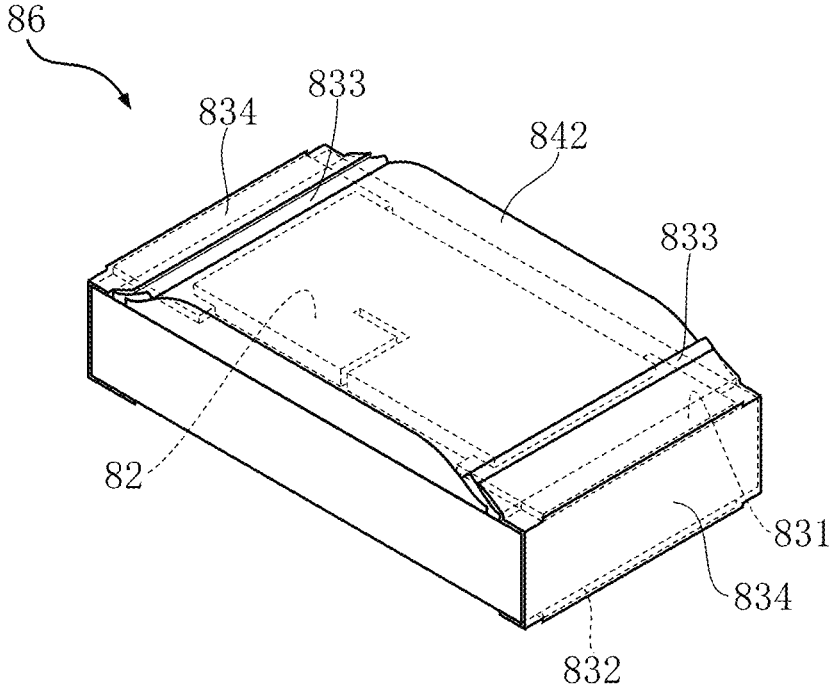
FIG. 17 is a perspective view illustrating a method of manufacturing the chip resistor shown in FIG. 1.
Figure 18:
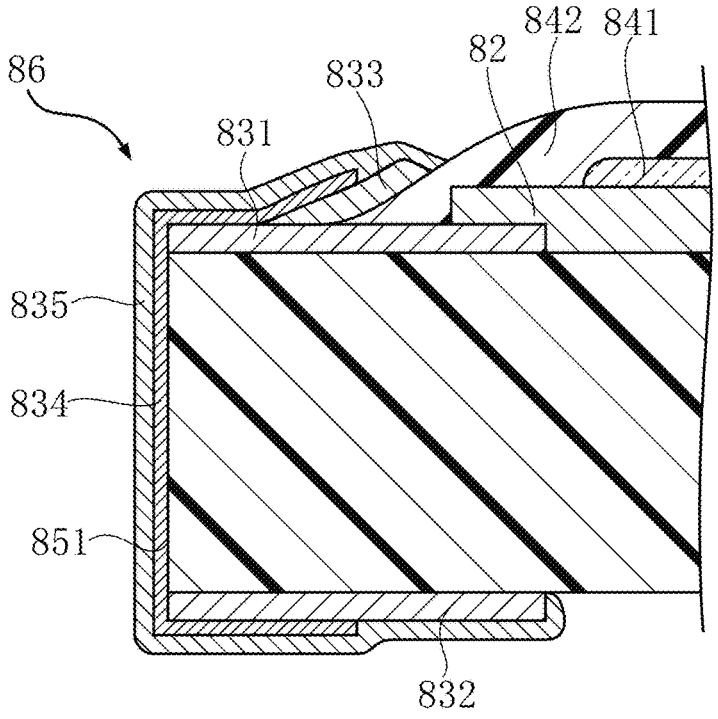
FIG. 18 is a sectional view illustrating a method of manufacturing the chip resistor shown in FIG. 1.
Figure 19:
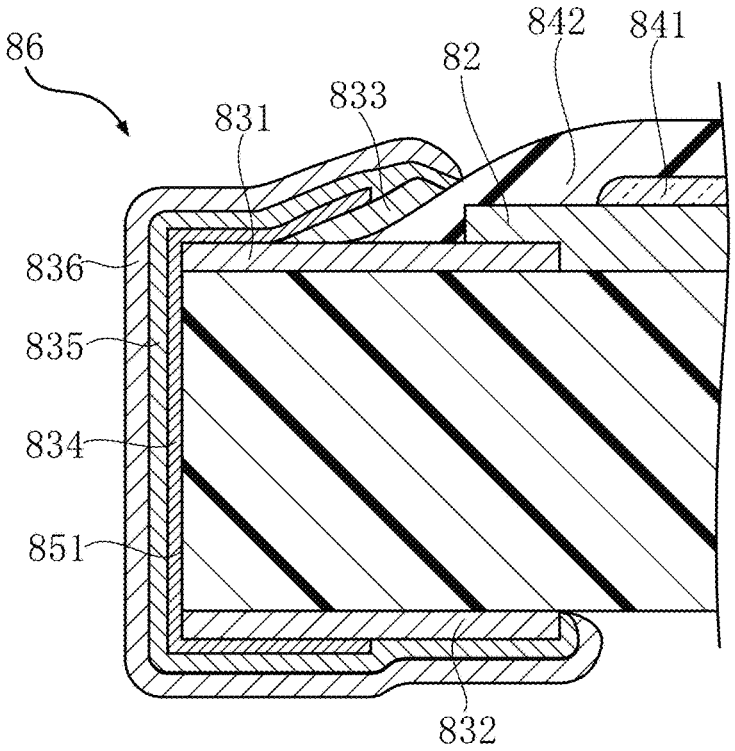
FIG. 19 is a sectional view illustrating a method of manufacturing the chip resistor shown in FIG. 1.

FIGS. 7 to 13 are plan views each illustrating a step of manufacturing the chip resistor A10. FIGS. 14 and 17 are perspective views each illustrating a step of manufacturing the chip resistor A10. FIG. 15 is a sectional view taken along line XV-XV of FIG. 14. FIGS. 16, 18 and 19 are sectional views each illustrating a step of manufacturing the chip resistor A10. The section shown in FIGS. 16, 18 and 19 are taken along the same line as FIG. 15. FIGS. 7 to 19 show the thickness direction Z, first direction X and second direction Y of a later-described base 81, which respectively correspond to the thickness direction Z, first direction X and second direction Y of the substrate 1 shown in FIGS. 1 to 5.

Figure 7:
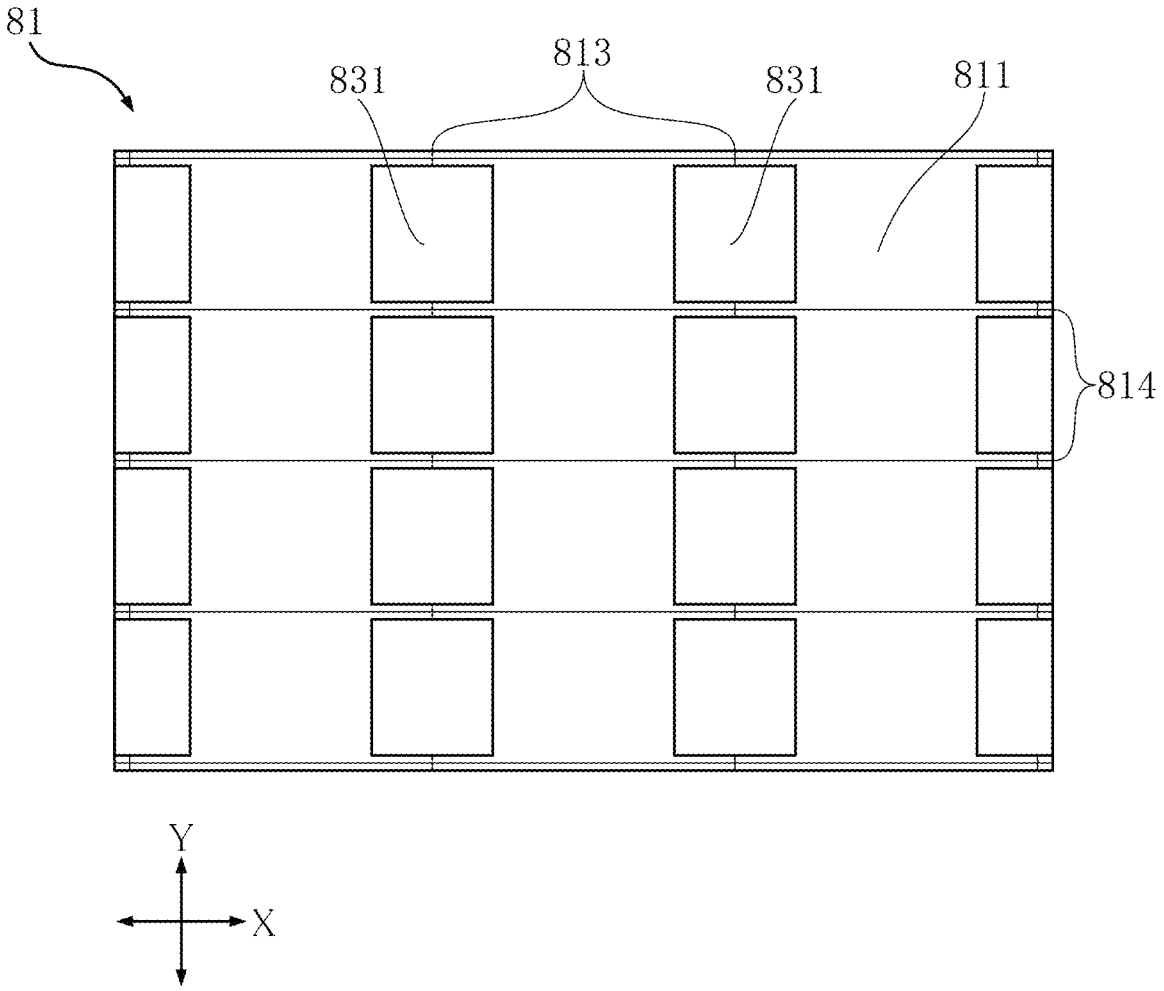
FIG. 7 is a plan view illustrating a method of manufacturing the chip resistor shown in FIG. 1.

First, as shown in FIG. 7, a base 81 is in the form of a sheet having a front surface 811 and a back surface 812 that are spaced apart from each other in the thickness direction Z. A pair of regions spaced apart from each other are formed on the front surface 811, whereby a pair of top electrodes 831 are formed. The top electrodes 831 correspond to the top electrodes 31 of a chip resistor A10. The base 81 of the present embodiment is made of alumina. As shown in FIG. 7, the base 81 has a plurality of grooves recessed in the front surface 811. The plurality of grooves include primary grooves 813 extending in the second direction Y and secondary grooves 814 extending in the first direction X, thereby defining a grid pattern. Each region bounded by the primary grooves 813 and the secondary grooves 814 corresponds to the substrate 1 of a chip resistor A10. That is, the base 81 is a collection of a plurality of substrates 1. Each top electrode 831 formed in contact with the front surface 811 spans a primary groove 813. The top electrodes 831 are formed by using a printing technique. In the present embodiment, the top electrodes 831 are made from a paste containing Ag particles mixed with glass frit. The paste is printed on the front surface 811 using a silk screen, followed by baking.

Figure 8:
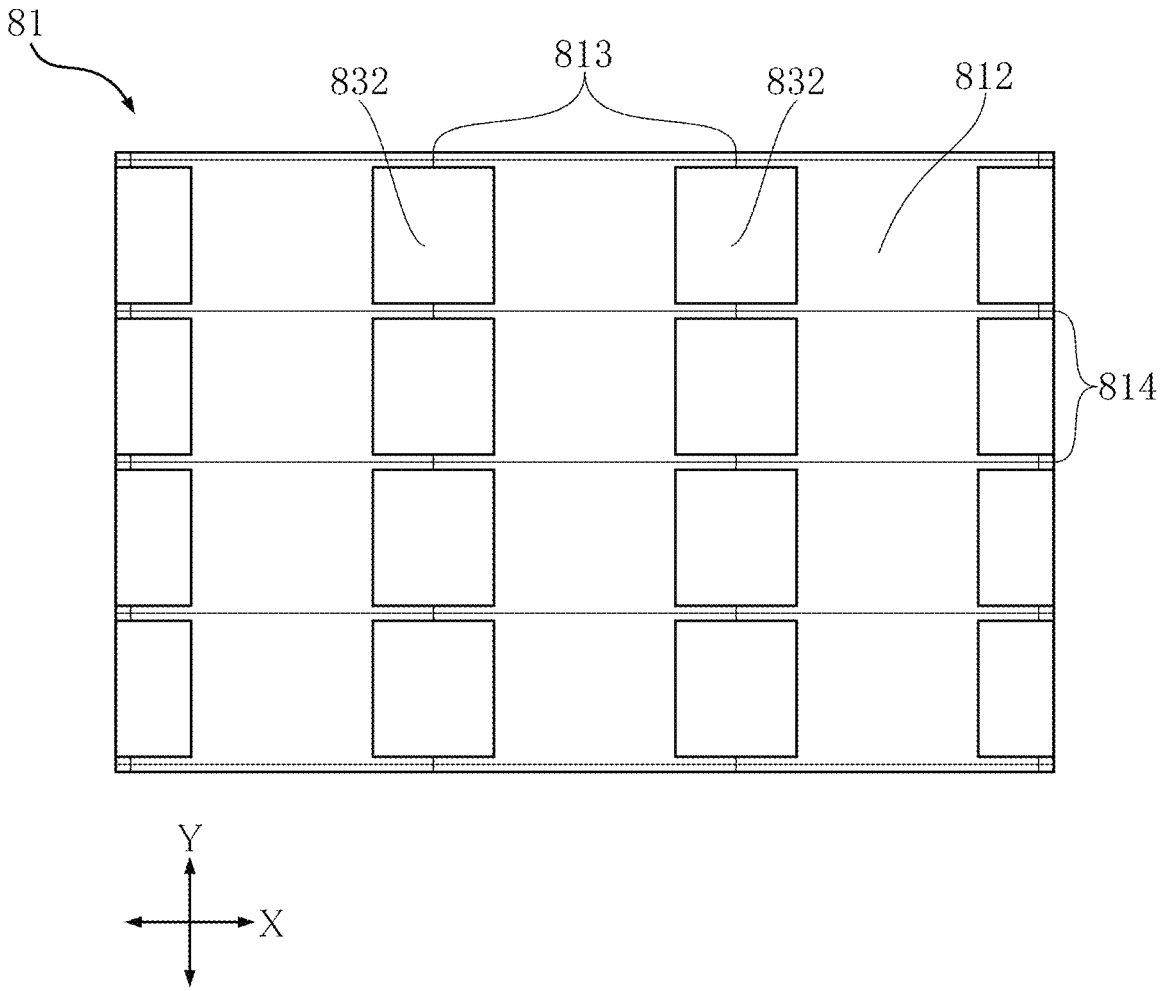
FIG. 8 is a plan view illustrating a method of manufacturing the chip resistor shown in FIG. 1.

Next, as shown in FIG. 8, a pair of back electrodes 832 composed of a pair of regions spaced apart from each other are formed on the back surface 812 of the base 81. The back electrodes 832 correspond to the back electrodes 32 of a chip resistors A10. As shown in FIG. 8, the base 81 has a plurality of grooves recessed in the back surface 812. The plurality of grooves include primary grooves 813 and secondary grooves 814, respectively corresponding in position to the primary grooves 813 and the secondary grooves 814 formed in the front surface 811. Each back electrode 832 formed in contact with the back surface 812 spans a primary groove 813. The back electrodes 832 are formed by using a printing technique. In the present embodiment, the back electrodes 832 are made from a paste containing primarily a flexible epoxy resin and containing flaky Ag particles. The paste is printed on the back surface 812 using a silk screen, followed by baking. The back electrodes 832 are formed at locations corresponding to the top electrodes 831 already formed on the front surface 811.

Figure 9:
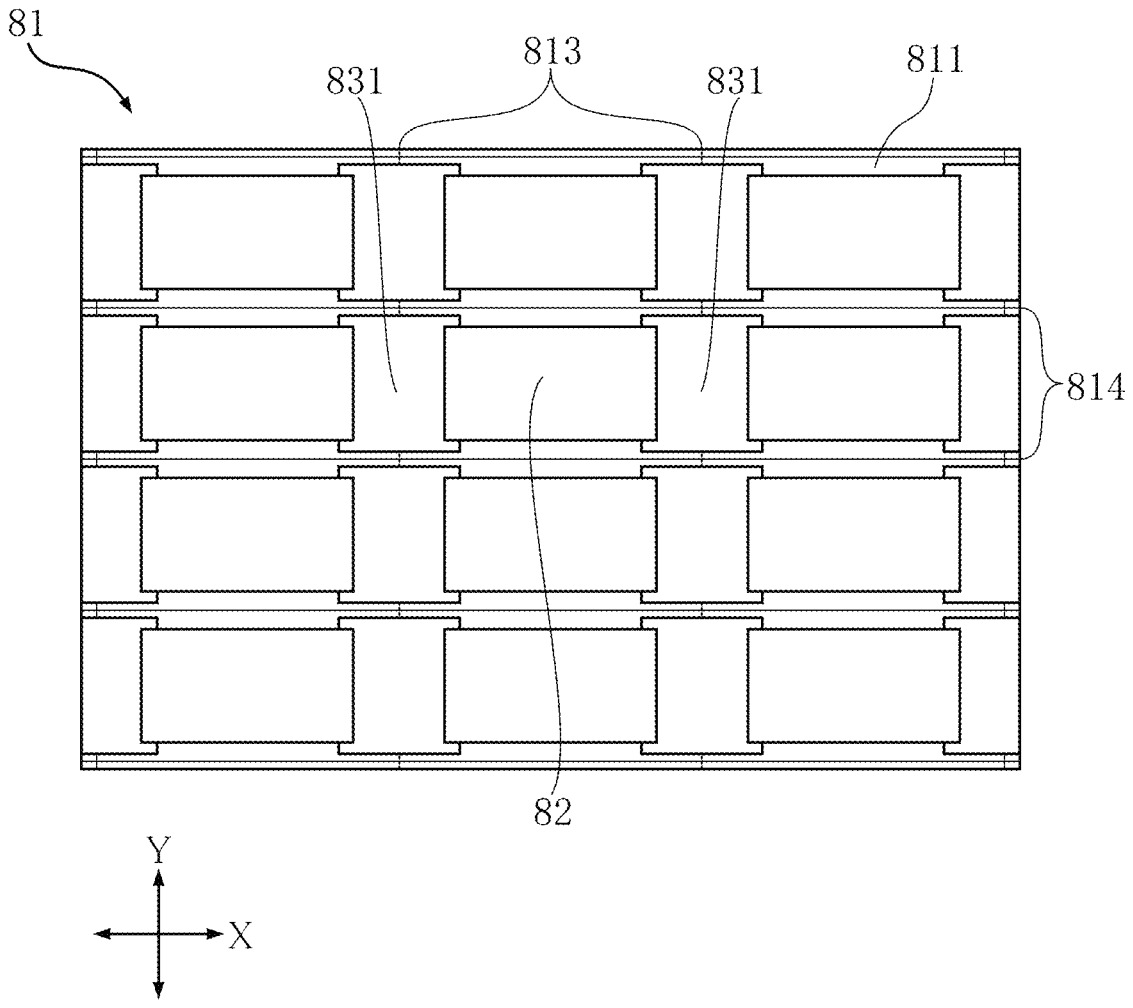
FIG. 9 is a plan view illustrating a method of manufacturing the chip resistor shown in FIG. 1.

Then, as shown in FIG. 9, a resistor 82 is formed such that the opposite edges of the resistor 82 in the first direction X are in contact with the pair of top electrodes 831. The resistor 82 corresponds to the resistor 2 of a chip resistor A10. The resistor 82 is formed by using a printing technique. In the present embodiment, the resistor 82 is made from a paste containing metal particles, such as $Ruo_2$ or an Ag—Pd alloy, mixed with glass frit. The paste is printed on the front surface 811 using a silk screen, followed by baking.

Figure 10:
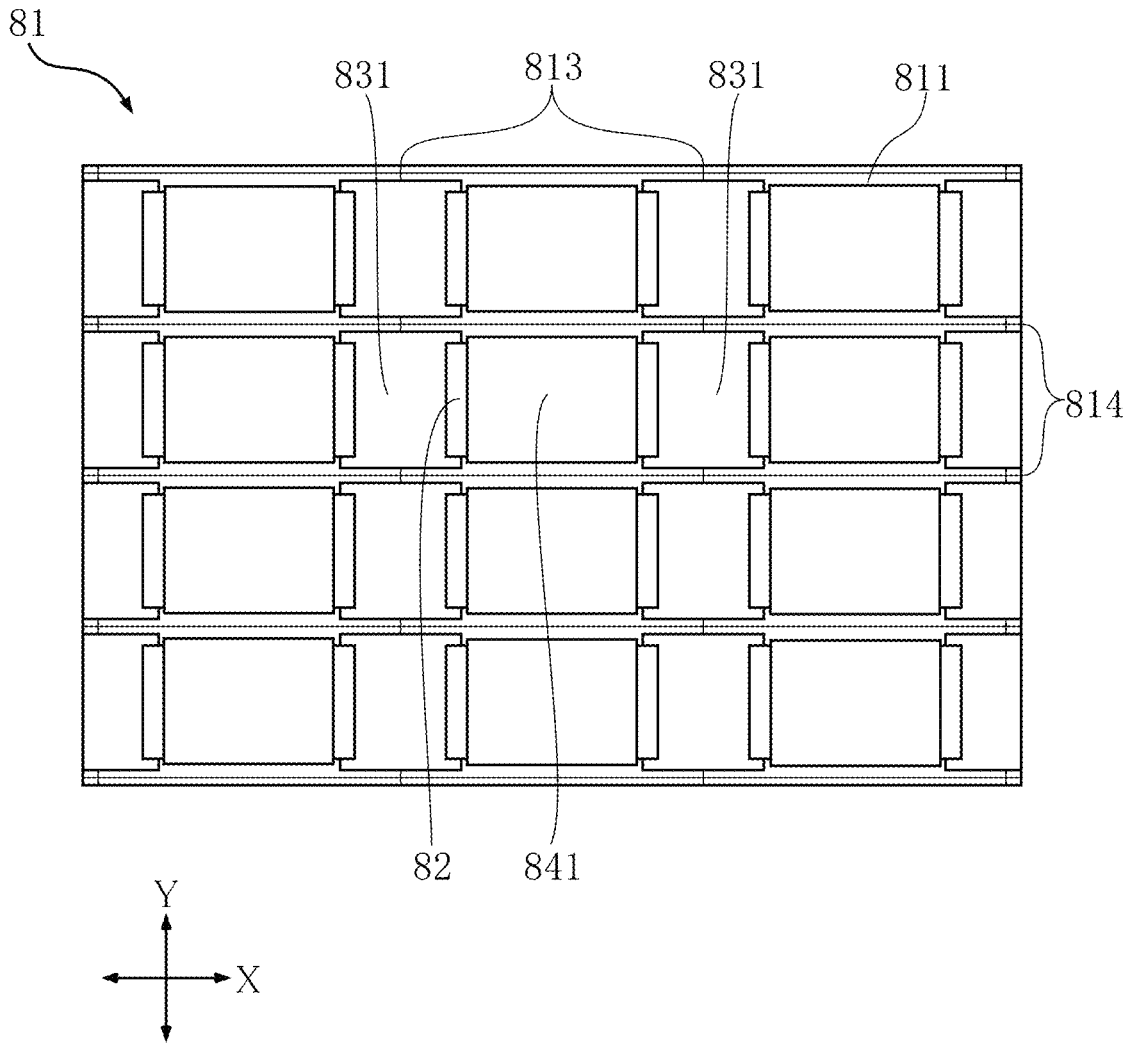
FIG. 10 is a plan view illustrating a method of manufacturing the chip resistor shown in FIG. 1.

Then, as shown in FIG. 10, a protective film 841 is formed in contact with the resistor 82. The protective film 841 corresponds to the lower protective layer 41 of a chip resistor A10. The protective film 841 of the present embodiment is formed by printing a glass paste on the resistor 82 using a silk screen, followed by baking.

Figure 11:
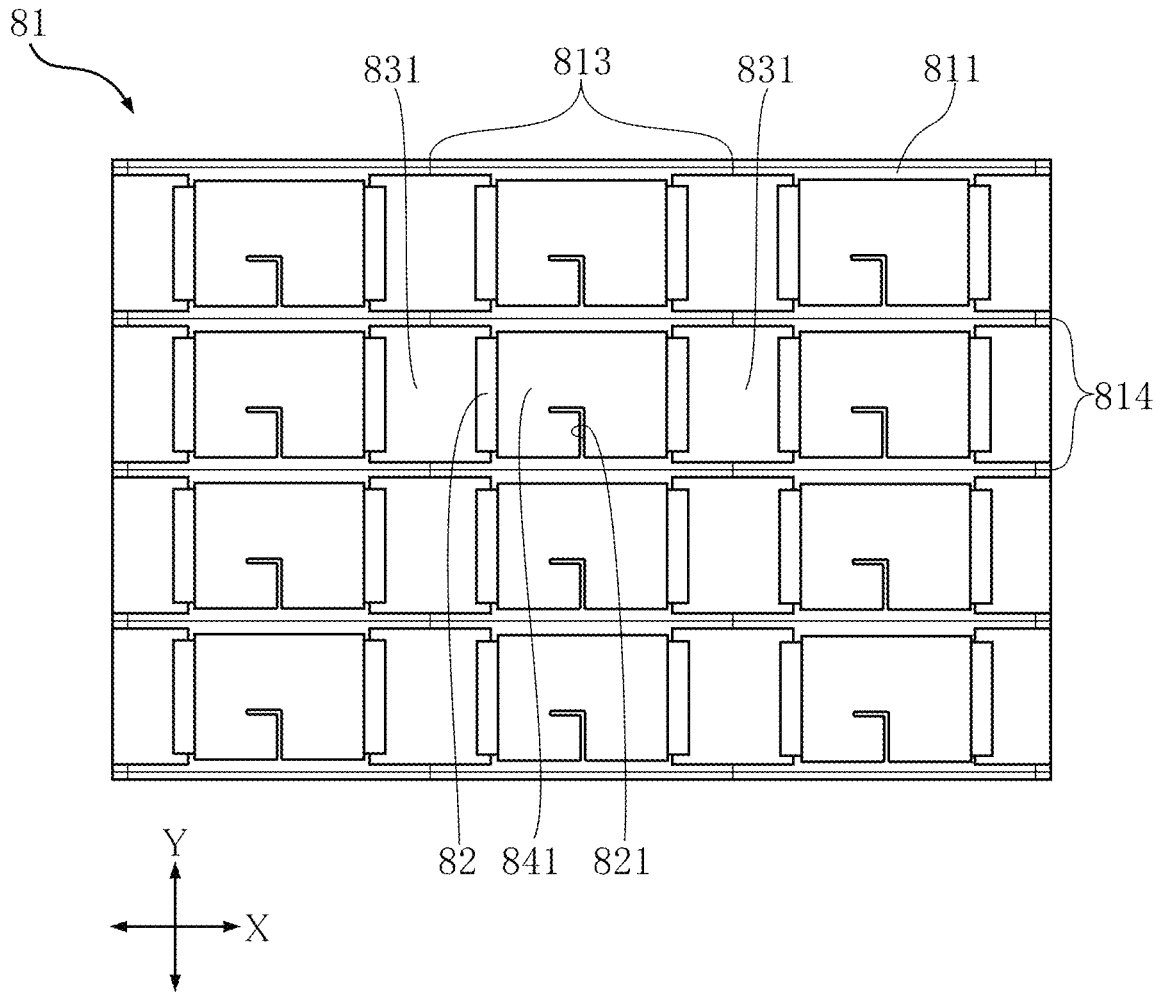
FIG. 11 is a plan view illustrating a method of manufacturing the chip resistor shown in FIG. 1.

Then, as shown in FIG. 11, a trimming groove 821 is formed through the resistor 82 in the thickness direction Z of the base 81. The trimming groove 821 corresponds to the trimming groove 21 of a chip resistor A10. The trimming groove 821 is formed with a laser trimming machine. A trimming groove 821 is formed in a resistor 82 through the following process. First, a resistance measurement probe is placed in contact with the ends of the resistor 82 in the first direction X. Then, while the probe is kept in contact, the resistor 82 is cut from an edge parallel to the first direction X to form a first part of the trimming groove 821 extending in the second direction Y. When the cut arrives at a point where the resistance value of the resistor 82 has increased close to a predetermined value (the resistance value of the chip resistor A10), the direction of cut is turned 90° to form a second part of the trimming groove 821 extending in the first direction X. When the predetermined resistance value is reached, the trimming process is stopped and the trimming groove 821 is completed. By this trimming process, an L-shape trimming groove 821 in plan view is formed in the resistor 82. In the trimming process, the protective film 841 is cut together with the resistor, so that a trimming groove is formed through the protective film 841 in the thickness direction of the base 81. Naturally, this trimming groove is identical to the trimming groove 821.

Figure 12:
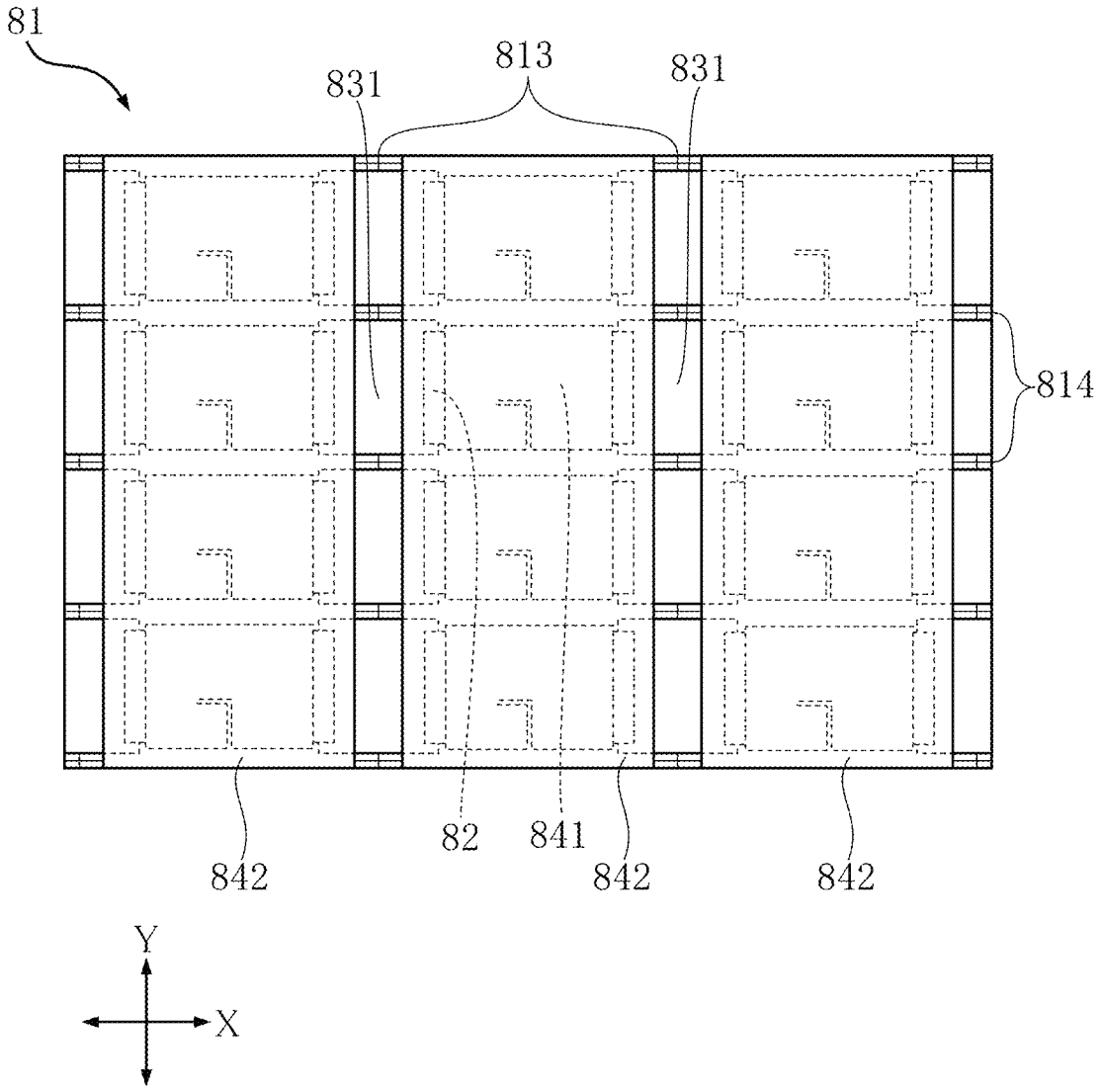
FIG. 12 is a plan view illustrating a method of manufacturing the chip resistor shown in FIG. 1.

Then, as shown in FIG. 12, a protective layer 842 is formed in contact with the resistor 82. The protective layer 842 corresponds to the upper protective layer 42 of a chip resistor A10. In the present embodiment, the protective layer 842 is made from a paste containing primarily an epoxy resin. The paste is printed using a silk screen to completely cover the resistor 82 and the protective film 841, followed by hardening the printed paste. In the present embodiment, a plurality protective layers 842 are formed in a strip shape elongated in the second direction Y across a subset of secondary grooves 814 in the base 81. In this state, at the opposite edges of each protective layer 842 in the first direction X, the pairs of top electrodes 831 are exposed. Alternatively, separate protective layers 842 may be formed for the individual resistors 82, similarly to the protective films 841 shown in FIG. 10.

Figure 13:
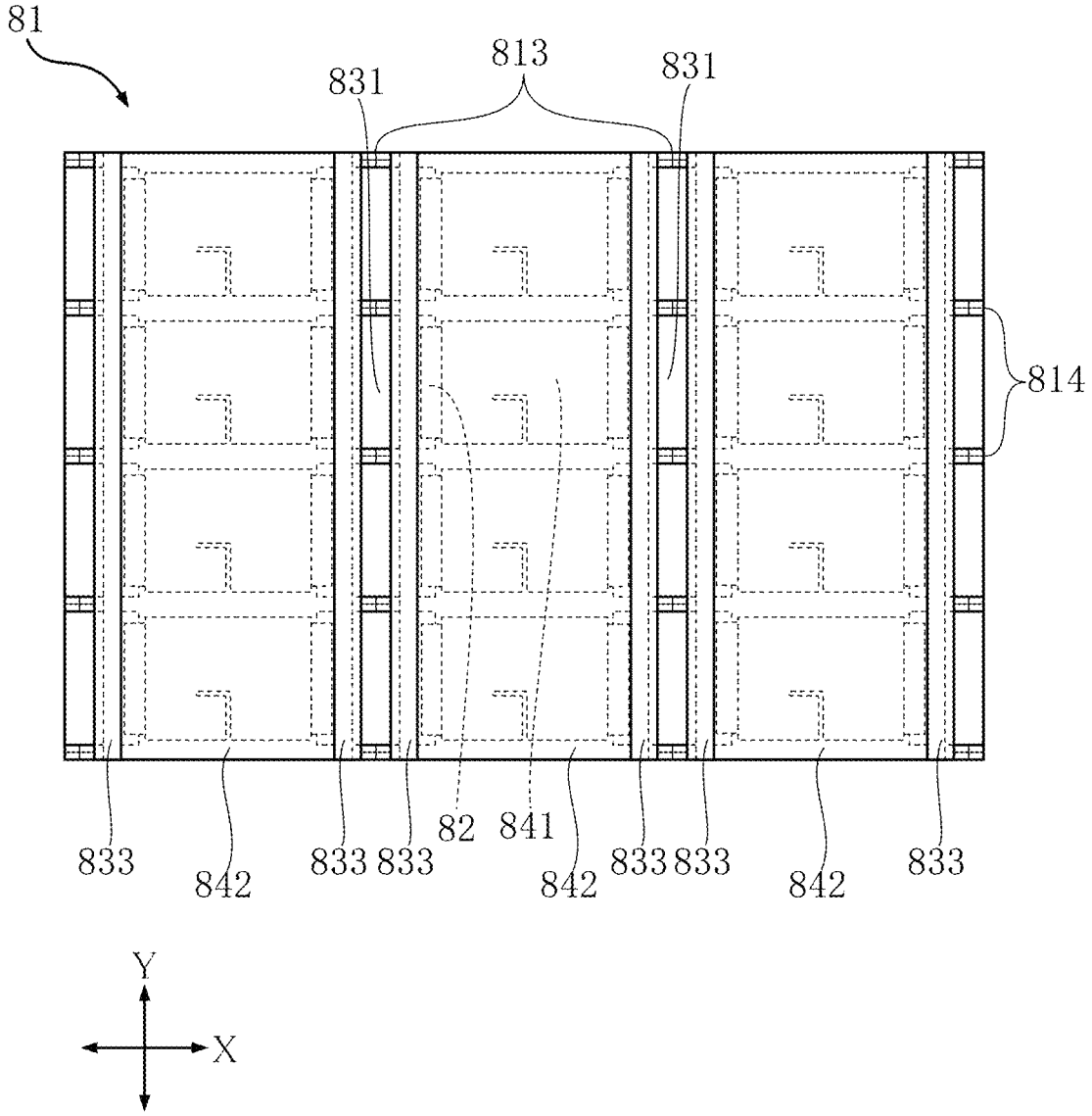
FIG. 13 is a plan view illustrating a method of manufacturing the chip resistor shown in FIG. 1.

Then, as shown in FIG. 13, protective electrodes 833 are formed such that each protective layer 833 is in contact with both a top electrode 831 and a protective layer 842. The protective electrodes 833 correspond to the protective electrodes 33 of a chip resistors A10. The protective electrodes 833 are formed by using a printing technique. In the present embodiment, the protective electrodes 833 is made from an epoxy-resin based paste containing Ag particles. The paste is applied using a silk screen to cover the edges of the protective films 841 each of which covers a top electrode 831. The printed paste is then hardened. In the present embodiment, a plurality of protective electrodes 833 are formed in a strip shape extending in the second direction Y. In this state, between each two protective electrodes 833 where portions of the top electrodes 831 are exposed, portions of the primary grooves 813 are exposed as well. In another embodiment, the protective electrodes 833 may be made from a paste containing flaky carbon particles, rather than the paste containing Ag particles.

Next, as shown in FIG. 14, the base 81 is cut along the primary grooves 813, dividing the base 81 into a plurality of strips 85. Each strip 85 thus obtained has freshly cut side surfaces 851 extending from the front surface 811 to the back surface 812, at the ends opposite in the first direction X. The side surfaces 851 may be subjected to surface pretreatment by ion beam etching, for example. The side surfaces 851 roughened by the surface treatment can achieve good adhesion to side electrodes 834, which will be described later. The cross section of a strip 85 shown in FIG. 15 includes a side surface 851.

Next, as shown in FIG. 16, side electrodes 834 are formed such that each side electrode 834 has a part in contact with a side surface 851 of a strip 85, a part overlapping a front surface 811 in plan view, and a part overlapping aback surface 812 in plan view. The side electrodes 834 correspond to the side electrodes 34 of a chip resistors A10. The side electrodes 34 are formed by sputtering. In the present embodiment, the side electrodes 34 are made by sputter deposition of Ni—Cr alloy films. In the present embodiment, the side electrodes 834 are formed for a plurality of strips 85 that are stacked to align the respective side surfaces 851. Each side electrode 834 thus formed has a portion covering the entire side surface 851 of the strip 85. The side electrode 834 additionally has a portion overlapping the front surface 811 in plan view. This overlapping portion covers the portions of the front surface 811 and the top electrodes 831 exposed in the strip 85 and also covers a portion of the protective electrode 833. The side electrode 834 also has a portion overlapping the back surface 812 in plan view. This overlapping portion covers the portions of the back surface 812 exposed in the strip 85 and also covers portions of the back electrodes 832.

Next, as shown in FIG. 17, the base 81 is cut along the secondary grooves 814, dividing the strips 85 into a plurality of pieces 86.

Next, as shown in FIG. 18, for each piece 86, intermediate electrodes 835 are formed such that each intermediate electrode 835 covers a side electrode 834 and also covers the exposed portions of a back electrode 832 and a protective electrode 833 in the piece 86. The intermediate electrodes 835 correspond to the intermediate electrodes 35 of a chip resistors A10. The intermediate electrodes 835 are formed by electroplating. In this embodiment, the intermediate electrodes 835 are formed by electrolytic barrel plating to deposit Ni.

Finally, as shown in FIG. 19, outer electrodes 836 are formed to cover the intermediate electrodes 835. The outer electrodes 836 correspond to the outer electrodes 36 of a chip resistors A10. Similarly to the intermediate electrodes 835, the outer electrodes 836 are formed by electroplating. In the present embodiment, the outer electrodes 836 are formed by electrolytic barrel plating to deposit Sn. The piece 86 in this state corresponds to a chip resistor A10. By the above steps, the chip resistor A10 is completed.

In the chip resistor A10 thus manufactured, the top electrodes 31 are disposed on the front surface 11 of the substrate 1 and in contact with the resistor 2. The protective layer 4 (the upper protective layer 42) covers the resistor 2. The protective electrodes 33 are disposed in contact with the top electrodes 31. In the chip resistor A10, in addition, each side electrode 34 has a top portion 342 overlapping the front surface 11 of the substrate 1 in plan view and in contact with a top electrode 31. Each intermediate electrode 35 covers a protective electrode 33 and a side electrode 34. In this configuration, each protective electrode 33 is in contact with both a top electrode 31 and the protective layer 4. This ensures that the top portions 342 of the side electrodes 34 are completely isolated from the protective layer 4. Even if a top portion 342 is formed in contact with a protective layer 4, the area of contact is ensured to be small. In addition, even if the top portion 342 in contact with the protective layer 4 peels away, the peeling is stopped at the edge (first edge 331) of the protective electrode 33 defining the boundary with the protective layer 4. In this way, the protective electrodes 33 prevent ingress of sulfuric gas to the top electrodes 31. In addition, the protective electrodes 33 and the intermediate electrodes 35 covering the protective electrodes 33 provide a double-shielding structure to reliably prevent ingress of sulfuric gas to the top electrodes 31. The chip resistor A10 thus improves the sulfurization resistance.

According to the manufacturing method of the chip resistor A10, the side electrodes 834 are deposited by sputtering. Since the protective electrodes 833 are formed before the side electrodes 834 are formed, the protective electrodes 833 can block metal particles scattered during the formation of the side electrodes 834. This ensures that the resulting side electrodes 834 are completely isolated from the protective layer 842. Even if a side electrodes 834 is formed in contact with a protective layer 842, the area of contact is ensured to be small. In this way, the chip resistor A10 is provided with the side electrodes 34 having the top portions 342 having the above-described configuration.

The protective electrodes 33 are made of a synthetic resin containing Ag particles, so that good adhesion is achieved between each protective electrodes 33 and a corresponding protective layer 4. This is effective to prevent ingress of sulfuric gas from the interface between the protective electrode 33 and the protective layer 4. In addition, suppose that sulfuric gas enters through the interface between the intermediate electrode 35 and the protective layer 4, the Ag particles contained in the protective electrode 33 are sulfurized before the Ag particles contained in the top electrode 31. In this way, the protective electrodes 33 serve as sacrificial electrodes due to the configuration of the chip resistor A10. Thus, despite that the conductivity of the protective electrodes 33 may be reduced as a result of sulfurization of their Ag particles, electrical disconnection of the electrodes 3 is prevented.

In another configuration, the protective electrodes 33 may be made of a synthetic resin containing flaky carbon particles. The protective electrodes 33 of this configuration achieve good adhesion with the protective layer 4, and improve the sulfurization resistance of the protective electrodes 33. The carbon particles are less expensive than other sulfurization resistant particles, such as Pd particles. Thus, use of such particles make it possible to provide the protective electrodes 33 with improved sulfurization resistance and at lower manufacturing cost. In addition, the use of flaky carbon particles ensures the protective electrodes 33 to be bonded more firmly to the intermediate electrodes 35 due to an anchor effect. This further improves the sulfurization resistance of the chip resistor A10.

In plan view, each protective electrode 33 is positioned to leave a gap d between its second edge 332 and the side surface 13 of the substrate 1. This configuration is advantageous in the manufacture of the chip resistor A10 because the protective electrodes 833 can be formed without covering the primary grooves 813. This facilitates the cutting of the base 81 into a plurality of strips 85.

The side electrodes 34 is made of Ni—Cr alloy to render the side electrodes 34 resistant to sulfurization. This improves the sulfurization resistance of the chip resistor A10.

The back electrodes 32 disposed on the back surface 12 of the substrate 1 are made of a synthetic resin containing conductive particles 320. The conductive particles 320 are flaky Ag particles. During operation of the chip resistor A10, the solder bonded between the chip resistor A10 and the circuit board is subject to thermal stress induced by heat from the chip resistor A10. Repeated occurrences of such thermal stress may cause a crack in the solder, which leads to electrical disconnection. Owing to the above-described configuration, the back electrodes 32 can thermally expand and contract more flexibly, thereby mitigating the thermal stress. That is, the back electrodes 32 are effective to prevent cracking in the solder. In addition, the use of flaky conductive particles 320 creates anchor effect to improve adhesion of the back electrodes 32 to the intermediate electrodes 35, ensuring the back electrodes 32 to be more reliably protected by the intermediate electrodes 35.

Second Embodiment

Figure 20:
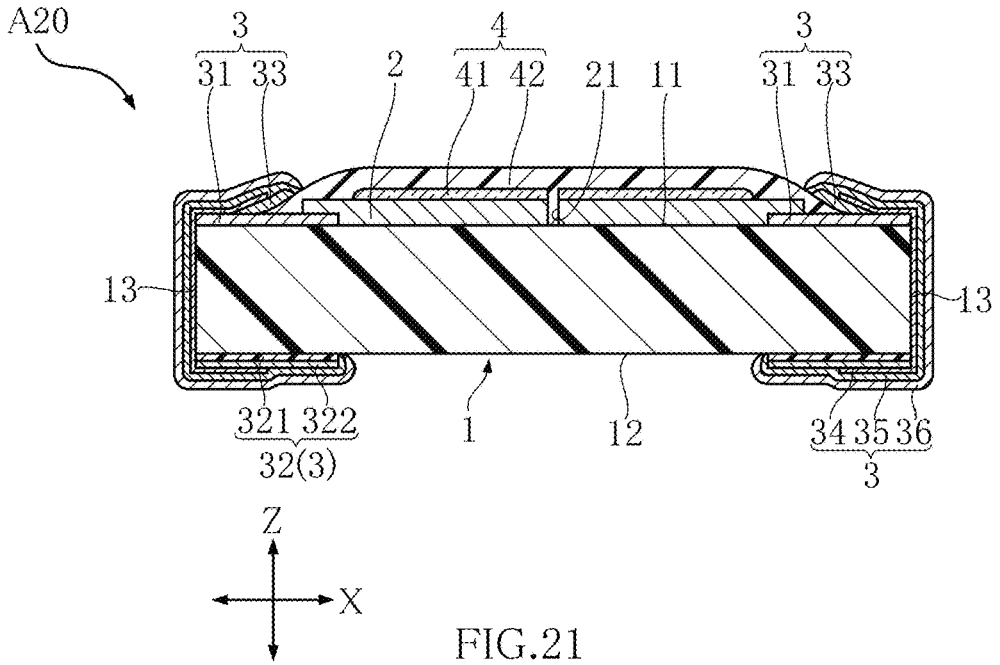
FIG. 20 is a sectional view of a chip resistor according to a second embodiment of the present disclosure.
Figure 21:
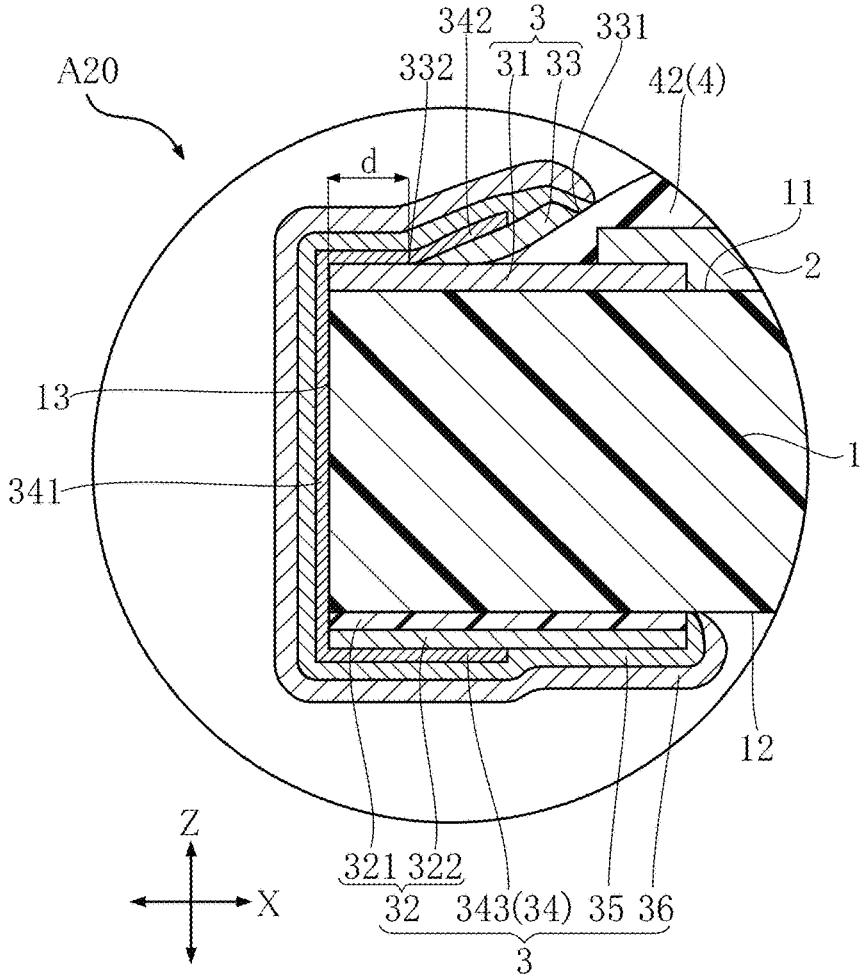
FIG. 21 is a partially enlarged view of FIG. 20.

With reference to FIGS. 20 and 21, the following describes a chip resistor A20 according to a second embodiment of the present disclosure. In these figures, the same or similar components to those of the chip resistor A10 are denoted by the same reference signs and not described to avoid redundancy.

FIG. 20 is a sectional view of the chip resistor A20. The position and range of the section shown in FIG. 20 correspond to the section of the chip resistor A10 shown in FIG. 4. FIG. 21 is a partially enlarged view of FIG. 20. In plan view, the chip resistor A20 has the same shape and size as the chip resistor A10.

The chip resistor A20 differs from the chip resistor A10 in the configuration of the back electrodes 32.

As shown in FIGS. 20 and 21, each back electrode 32 of the present embodiment includes a first layer 321 and a second layer 322. The first layer 321 is in contact with the back surface 12 of the substrate 1 and made of a synthetic resin, which is an electrically insulating material. The synthetic resin may be a flexible epoxy resin. The second layer 322 is disposed on the first layer 321 and made of a synthetic resin containing conductive particles 320. The second layer 322 is similar in configuration as the back electrodes 32 of the chip resistor A10. That is, the conductive particles 320 contained in the present embodiment are Ag flakes.

The chip resistor A20 includes top electrodes 31, a protective layer 4 (upper protective layer 42), protective electrodes 33, side electrodes 34 and intermediate electrodes 35. Those components are similar in configuration to the corresponding components of the chip resistor A10. Each protective electrode 33 contacts and covers both a top electrode 31 and the protective layer 4. That is, the chip resistor A20 ensures that the top portions 342 of the side electrodes 34 are isolated from the protective layer 4. Even if a side electrode 34 is formed in contact with a protective layer 4, the area of contact is ensured to be small. In addition, even if the top portion 342 in contact with the protective layer 4 peels away, the peeling does not proceed beyond the edge (first edge 331) of the protective electrode 33 defining the boundary with the protective layer 4. In this way, the protective electrode 33 does not allow ingress of sulfuric gas to the top electrodes 31. In addition, the protective electrodes 33 and the intermediate electrodes 35 covering the protective electrodes 33 provide a double-shielding structure to reliably prevent ingress of sulfuric gas to the top electrodes 31. In this way, the chip resistor A20 can improve the resistance to sulfurization.

Each back electrode 32 of this embodiment includes a first layer 321 in contact with the back surface 12 of the substrate 1 and a second layer 322 on the first layer 321. The first layer 321 is made of a synthetic resin, which is an electrically insulating material. The second layer 322 is made of a synthetic resin containing conductive particles 320. The conductive particles 320 are flaky Ag particles. This configuration ensures that the first layer 321 of the back electrode 32 bonds firmly to the substrate 1, and that the second layer 322 of the back electrode 32 bonds firmly to the intermediate electrode 35. With the back electrodes 32 firmly bonded to both the substrate 1 and the intermediate electrodes 35, the chip resistor A20 can be mounted to a circuit board more firmly.

Third Embodiment

With reference to FIGS. 22 to 25, the following describes a chip resistor A30 according to a third embodiment of the present disclosure. In these figures, the same or similar components to those of the chip resistor A10 are denoted by the same reference signs and not described to avoid redundancy.

Figure 22:
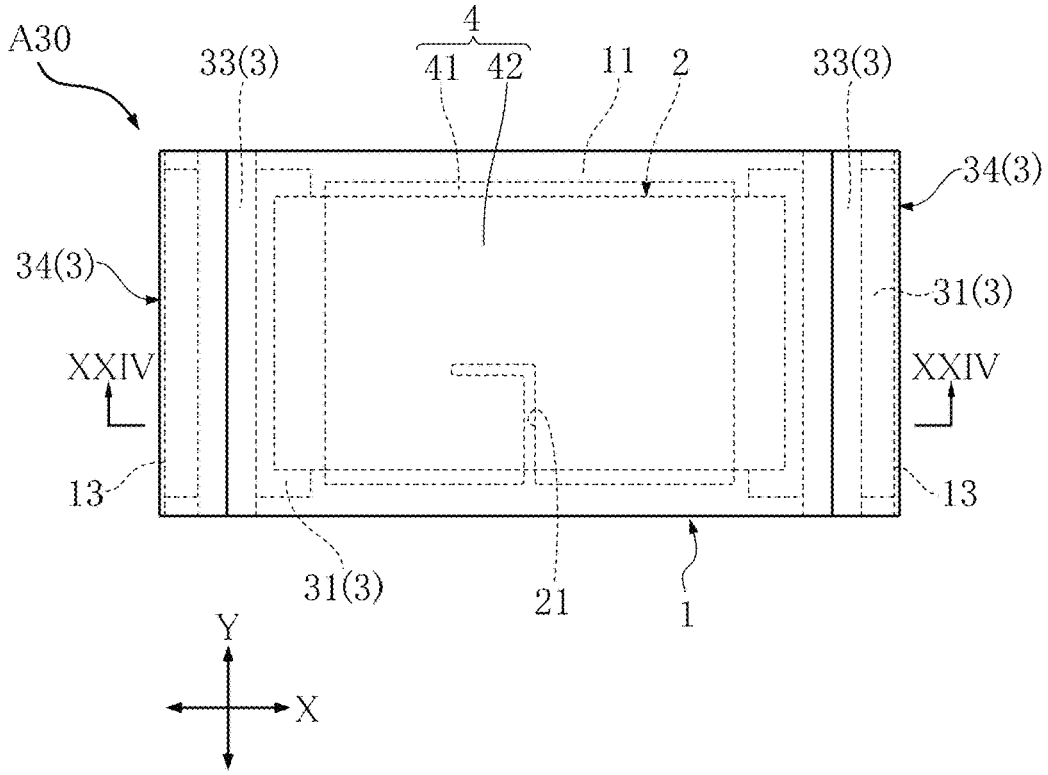
FIG. 22 is a plan view of a chip resistor according to a third embodiment of the present disclosure (seen through an intermediate electrode and an intermediate electrode).
Figure 23:
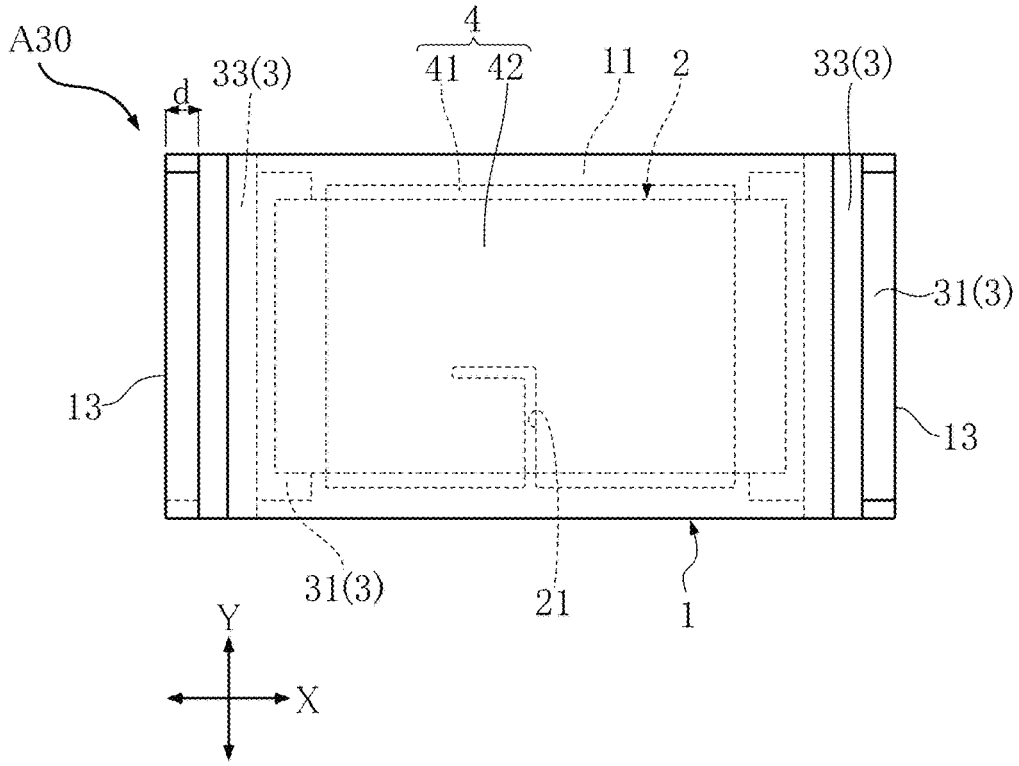
FIG. 23 is a plan view of the chip resistor shown in FIG. 22 (seen through side electrodes, intermediate electrodes and outer electrodes).
Figure 24:
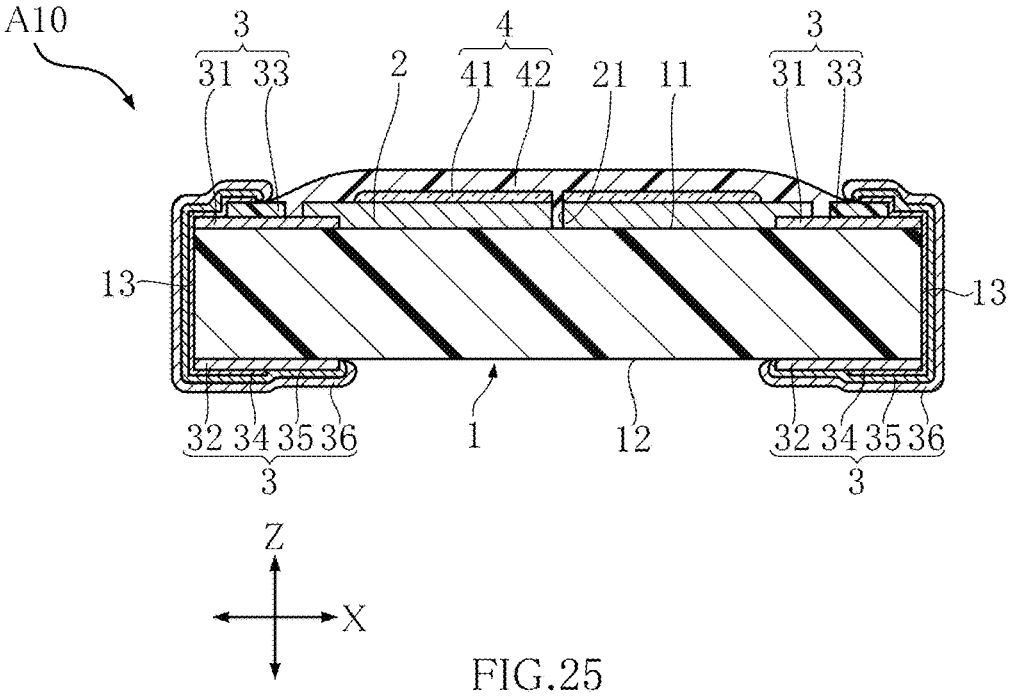
FIG. 24 is a sectional view taken along line XXIV-XXIV of FIG. 22.
Figure 25:
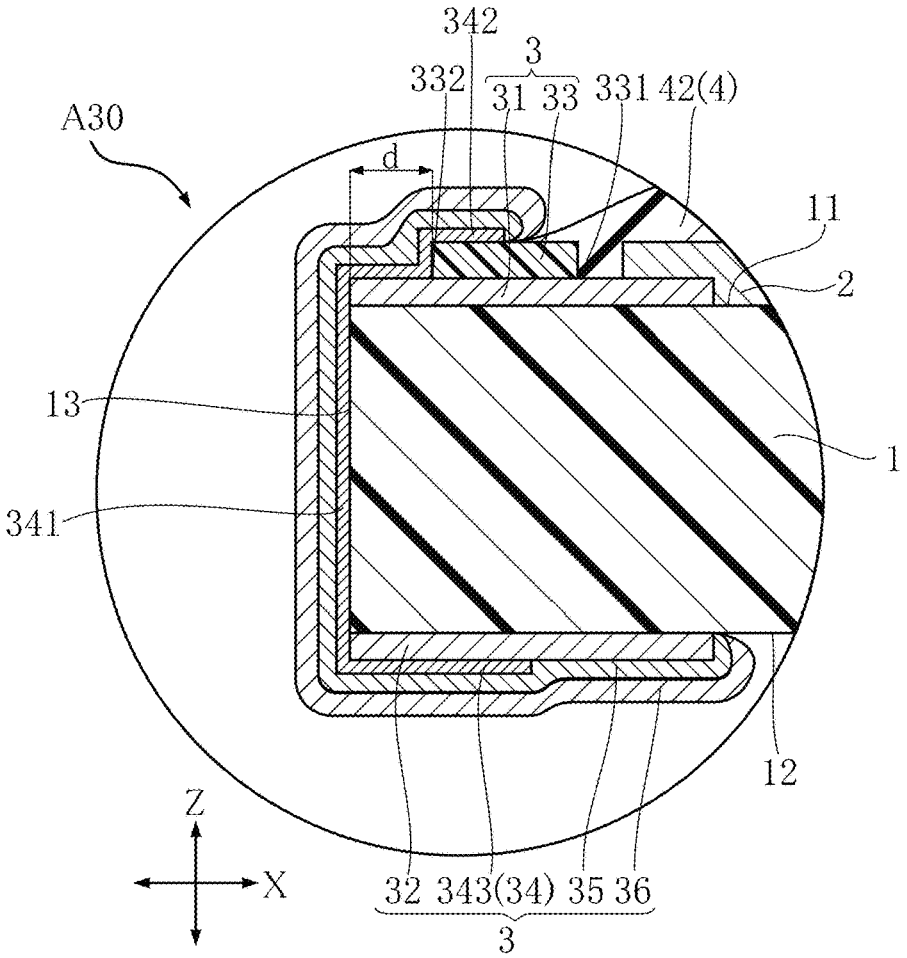
FIG. 25 is a partially enlarged view of FIG. 24.

FIG. 22 is a plan view of the chip resistor A30 seen through the intermediate electrodes 35 and the outer electrodes 36 of the electrodes 3 for convenience. FIG. 23 is a plan view corresponding to FIG. 22, seen further through the side electrodes 34 of the electrodes 3 for convenience. FIG. 24 is a sectional view taken along line XXIV-XXIV of FIG. 22. FIG. 25 is a partially enlarged view of FIG. 24.

The chip resistor A30 differs from the chip resistor A10 in the configuration of the protective electrodes 33 and the upper protective layer 42.

As shown in FIGS. 22 to 25, each protective electrode 33 is sandwiched between a top electrode 31 and a side electrode 34 in the thickens direction Z of the substrate 1, and also between the top electrode 31 and an upper protective layer 42. As shown in FIG. 25, the first edge 331 of the protective electrode 33 is in contact with the upper protective layer 42, and the second edge 332 is in contact with the side electrode 34. The present embodiment is configured to provide a gap d between the side surface 13 of the substrate 1 and the second edge 332. Thus, the top electrode 31 is exposed through the gap d, provided that the side electrode 34, the intermediate electrode 35 and the outer electrode 36 are omitted as in FIG. 23. The protective electrodes 33 of the present embodiment are made of a synthetic resin containing flaky carbon particles. The synthetic resin may be an epoxy resin. The dimensions of the carbon particles in a direction perpendicular to the thickness direction fall within a range of 5 to 15 μm in long-side dimension and 2 to 5 μm in short-side dimension.

As shown in FIG. 25, the opposite ends of the upper protective layer 42 in the first direction X cover portions of the protective electrodes 33.

The chip resistor A30 includes the components of similar configuration to those of the chip resistor A10, namely the top electrodes 31, side electrodes 34 and intermediate electrodes 35. Each protective electrode 33 is sandwiched between a top electrode 31 and a side electrode 34 and also between the top electrode 31 and a protective layer 4 (upper protective layer 42) in the thickness direction Z of the substrate 1. In this embodiment, even if the top portion 342 of a side electrode 34 is formed in contact with the protective layer 4, the top portion 342 is also in contact a protective electrode 33. It is thus ensured that the top portion 342 will remain bonded to the protective electrode 33, even if the top portion 342 peels away from the protective layer 4. With the double-shielding structure provided by the protective electrodes 33 and the intermediate electrodes 35, the chip resistor A30 can prevent ingress of sulfuric gas to the top electrode 31. In this way, the chip resistor A30 can improve the resistance to sulfurization.

The protective electrodes 33 are made of a synthetic resin containing flaky carbon particles, so that the sulfurization resistance of the protective electrodes 33 is improved. In addition, the carbon particles are less expensive than the sulfurization-resistant Pd particles, which facilitates low-cost manufacturing of the protective electrodes 33 with improved sulfurization resistance. In addition, the use of flaky carbon particles achieves the anchor effect, allowing the protective electrode 33 to be bonded to the intermediate electrode 35 more firmly. This further improves the sulfurization resistance of the chip resistor A30.

The present disclosure is not limited to embodiments described above, and various design changes can be made to the specific configuration of the various parts of the present disclosure.

The present disclosure also covers embodiments of the following clauses.

[Clause 1]

A chip resistor comprising:

a substrate having a front surface and a back surface spaced apart from each other in a thickness direction, and a side surface between the front surface and the back surface;

a top electrode disposed on the front surface;

a resistor disposed on the front surface and electrically connected to the top electrode;

a protective layer covering the resistor;

a protective electrode electrically connected to the top electrode;

a side electrode electrically connected to the top electrode, the side electrode having a side portion disposed on the side surface, and a top portion and a bottom portion respectively overlapping the front surface and the back surface in plan view;

an intermediate electrode covering the protective electrode and the side electrode; and an outer electrode covering the intermediate electrode, wherein the protective electrode is in contact with both the top electrode and the protective layer and covers a portion of the top electrode and a portion of the protective layer.

[Clause 2]

The chip resistor according to Clause 1, wherein the protective electrode has a first edge and a second edge both extending parallel to the side surface of the substrate in plan view, and the first edge is in contact with the protective layer, and the second edge is in contact with the top electrode.

[Clause 3]

The chip resistor according to Clause 2, wherein in plan view, a gap is provided between the side surface of the substrate and the second edge of the protective electrode.

[Clause 4]

The chip resistor according to Clause 2 or 3, wherein the top portion of the side electrode is in contact with the protective electrode.

[Clause 5]

The chip resistor according to any one of Clauses 2 to 4, wherein the side electrode is made of a Ni—Cr alloy.

[Clause 6]

The chip resistor according to any one of Clauses 1 to 5, wherein the protective electrode is made of a synthetic resin containing metal particles.

[Clause 7]

The chip resistor according to Clause 6, wherein the metal particles include Ag particles.

[Clause 8]

The chip resistor according to any one of Clauses 1 to 5, wherein the protective electrode is made of a synthetic resin containing flaky carbon particles.

[Clause 9]

The chip resistor according to any one of Clauses 1 to 8, wherein the top electrode contains Ag particles.

[Clause 10]

The chip resistor according to any one of Clauses 1 to 9, further comprising a back electrode disposed on the back surface of the substrate and electrically connected to the side electrode, the back electrode including a synthetic resin containing conductive particles, wherein the bottom portion of the side electrode is in contact with the back electrode, and the intermediate electrode covers the back electrode.

[Clause 11]

The chip resistor according to Clause 10, wherein the back electrode includes:

a first layer disposed in contact with the back surface of the substrate and made of an electrically-insulating synthetic resin; and a second layer disposed on the first layer and made of a synthetic resin containing conductive particles.

[Clause 12]

The chip resistor according to Clause 10 or 11, wherein the conductive particles are flakes of a metal.

[Clause 13]

The chip resistor according to Clause 12, wherein the metal is Ag.

[Clause 14]

The chip resistor according to any one of Clauses 1 to 13, wherein the resistor contains $Ruo_2$ or a Ag—Pd alloy, in addition to glass.

[Clause 15]

The chip resistor according to Clause 14, wherein the resistor has a trimming groove formed therethrough in a thickness direction of the substrate.

[Clause 16]

The chip resistor according to Clause 15, wherein the protective layer includes a lower protective layer in contact with the resistor and an upper protective layer disposed on the lower protective layer, and a portion of the protective electrode is in contact with the upper protective layer.

[Clause 17]

The chip resistor according to Clause 16, wherein the lower protective layer contains glass.

[Clause 18]

The chip resistor according to Clause 16, wherein the upper protective layer is made of an epoxy resin.

[Clause 19]

The chip resistor according to any one of Clauses 1 to 18, wherein the outer electrode is made of Sn.

[Clause 20]

The chip resistor according to Clause 19, wherein the intermediate electrode is made of Ni.

[Clause 21]

The chip resistor according to any one of Clauses 1 to 20, wherein the substrate is made of alumina.

[Clause 22]

A method of manufacturing a chip resistor, the method comprising:

forming, on a sheet-like base having a front surface and a back surface spaced apart from each other in a thickness direction, a top electrode having two separate regions disposed in contact with the front surface;

forming a resistor having a first edge and a second edge both in contact with the top electrode;

forming a protective layer covering the resistor;

forming a protective electrode in contact with both the top electrode and the protective layer;

dividing the base into a plurality of strips, each of the plurality of strips having a side surface between the front surface and the back surface;

forming a side electrode in contact with the side surface of one of the plurality of strips, the side electrode having a portion overlapping the front surface and a portion overlapping the back surface both in plan view;

forming an intermediate electrode covering the protective electrode and the side electrode; and forming an outer electrode covering the intermediate electrode.

[Clause 23]

The method according to Clause 22, wherein the forming of the protective electrode comprises forming the protective electrode by a printing technique.

[Clause 24]

The method according to Clause 22 or 23, wherein the forming of the side electrode comprises forming the side electrode by sputtering.

[Clause 25]

The method according to any one of Clauses 22 to 24, further comprising dividing the strips into individual pieces, between the forming of the side electrode and the forming of the intermediate electrode.

[Clause 26]

The method according to Clause 25, wherein the forming of the intermediate electrode and the forming of the outer electrode comprise forming the intermediate electrode and the outer electrode by electroplating.

[Clause 27]

The method according to any one of Clauses 22 to 26, further comprising forming aback electrode having two separate regions in contact with the back surface, before the forming of the resistor.

[Clause 28]

The method according to any one of Clauses 22 to 27, wherein the forming of the resistor comprises forming the resistor by using a printing technique.

[Clause 29]

The method according to Clause 28, wherein the forming of the resistor comprises forming a trimming groove through the resistor in a thickness direction of the base.

[Clause 30]

The method according to Clause 29, wherein the forming of the resistor comprises forming a protective film in contact with the resistor, before the forming of the trimming groove.

The invention claimed is:

1. A chip resistor comprising:

a substrate having a front surface and a back surface spaced apart from each other in a thickness direction, and a side surface between the front surface and the back surface;

a top electrode disposed on the front surface;

a resistor disposed on the front surface and electrically connected to the top electrode;

a protective layer covering the resistor;

a protective electrode electrically connected to the top electrode;

a side electrode electrically connected to the top electrode, the side electrode having a side portion disposed on the side surface, and a top portion and a bottom portion respectively overlapping the front surface and the back surface in plan view;

an intermediate electrode covering the protective electrode and the side electrode; and an outer electrode covering the intermediate electrode, wherein the protective electrode is in contact with both the top electrode and the protective layer and covers a portion of the top electrode and a portion of the protective layer, and wherein the protective electrode is made of a synthetic resin containing metal particles.

2. The chip resistor according to claim 1, wherein the protective electrode has a first edge and a second edge both extending parallel to the side surface of the substrate in plan view, and the first edge is in contact with the protective layer, and the second edge is in contact with the top electrode.

3. The chip resistor according to claim 2, wherein in plan view, a gap is provided between the side surface of the substrate and the second edge of the protective electrode.

4. The chip resistor according to claim 2, wherein the top portion of the side electrode is in contact with the protective electrode.

5. The chip resistor according to claim 2, wherein the side electrode is made of a Ni—Cr alloy.

6. The chip resistor according to claim 1, wherein the metal particles include Ag particles.

7. The chip resistor according to claim 1, wherein the top electrode contains Ag particles.

8. The chip resistor according to claim 1, wherein the resistor contains $Ruo_2$ or a Ag—Pd alloy, in addition to glass.

9. The chip resistor according to claim 8, wherein the resistor has a trimming groove formed therethrough in a thickness direction of the substrate.

10. The chip resistor according to claim 1, wherein the outer electrode is made of Sn.

11. The chip resistor according to claim 10, wherein the intermediate electrode is made of Ni.

12. The chip resistor according to claim 1, wherein the substrate is made of alumina.

13. A chip resistor according to claim 1, comprising:

a substrate having a front surface and a back surface spaced apart from each other in a thickness direction, and a side surface between the front surface and the back surface;

a top electrode disposed on the front surface;

a resistor disposed on the front surface and electrically connected to the top electrode;

a protective layer covering the resistor;

a protective electrode electrically connected to the top electrode;

a side electrode electrically connected to the top electrode, the side electrode having a side portion disposed on the side surface, and a top portion and a bottom portion respectively overlapping the front surface and the back surface in plan view;

an intermediate electrode covering the protective electrode and the side electrode; and an outer electrode covering the intermediate electrode, wherein the protective electrode is in contact with both the top electrode and the protective layer and covers a portion of the top electrode and a portion of the protective layer, and wherein the protective electrode is made of a synthetic resin containing flaky carbon particles.

14. A chip resistor comprising:

a substrate having a front surface and a back surface spaced apart from each other in a thickness direction, and a side surface between the front surface and the back surface;

a top electrode disposed on the front surface;

a resistor disposed on the front surface and electrically connected to the top electrode;

a protective layer covering the resistor;

a protective electrode electrically connected to the top electrode;

a side electrode electrically connected to the top electrode, the side electrode having a side portion disposed on the side surface, and a top portion and a bottom portion respectively overlapping the front surface and the back surface in plan view;

an intermediate electrode covering the protective electrode and the side electrode; and an outer electrode covering the intermediate electrode, wherein the protective electrode is in contact with both the top electrode and the protective layer and covers a portion of the top electrode and a portion of the protective layer, the chip resistor further comprising a back electrode disposed on the back surface of the substrate and electrically connected to the side electrode, the back electrode including a synthetic resin containing conductive particles, wherein the bottom portion of the side electrode is in contact with the back electrode, and the intermediate electrode covers the back electrode.

15. The chip resistor according to claim 14, wherein the back electrode includes:

a first layer disposed in contact with the back surface of the substrate and made of an electrically-insulating synthetic resin; and a second layer disposed on the first layer and made of a synthetic resin containing conductive particles.

16. The chip resistor according to claim 14, wherein the conductive particles are flakes of a metal.

17. The chip resistor according to claim 16, wherein the metal is Ag.

18. A chip resistor comprising:

a substrate having a front surface and a back surface spaced apart from each other in a thickness direction, and a side surface between the front surface and the back surface;

a top electrode disposed on the front surface;

a resistor disposed on the front surface and electrically connected to the top electrode;

a protective layer covering the resistor;

a protective electrode electrically connected to the top electrode;

a side electrode electrically connected to the top electrode, the side electrode having a side portion disposed on the side surface, and a top portion and a bottom portion respectively overlapping the front surface and the back surface in plan view;

an intermediate electrode covering the protective electrode and the side electrode; and an outer electrode covering the intermediate electrode, wherein the protective electrode is in contact with both the top electrode and the protective layer and covers a portion of the top electrode and a portion of the protective layer, and wherein the protective layer includes a lower protective layer in contact with the resistor and an upper protective layer disposed on the lower protective layer, and wherein a portion of the protective electrode is in contact with the upper protective layer.

19. The chip resistor according to claim 18, wherein the lower protective layer contains glass.

20. The chip resistor according to claim 18, wherein the upper protective layer is made of an epoxy resin.

* * * * *